United States Patent [19]

Hilsey

[11] 4,290,246

[45] Sep. 22, 1981

[54] MULTI-PURPOSE PRECAST CONCRETE PANELS, AND METHODS OF CONSTRUCTING CONCRETE STRUCTURES EMPLOYING THE SAME

[76] Inventor: Arthur E. Hilsey, 6409 SE. Evergreen Hwy., Vancouver, Wash. 98661

[21] Appl. No.: 962,852

[22] Filed: Nov. 22, 1978

[51] Int. Cl.[3] ..... E02D 27/00

[52] U.S. Cl. ..... 52/169.1; 52/80; 52/125; 52/227; 52/293; 52/582; 52/742; 52/743

[58] Field of Search ..... 52/80, 82, 227, 396, 52/262, 169.1, 125, 293, 582, 584, 742, 743; 404/6; 405/114, 116; 256/13.1

[56] References Cited

U.S. PATENT DOCUMENTS

| | | | |
|---|---|---|---|
| 932,261 | 8/1901 | Flynn | 52/293 X |
| 1,317,137 | 9/1919 | Isbegter | 52/583 |
| 1,371,709 | 3/1921 | Stockfleith | 405/114 |
| 1,539,033 | 5/1925 | Youngblood | 52/293 |
| 1,892,605 | 12/1932 | Betzler | 52/293 |
| 2,611,262 | 9/1952 | Dodson et al. | 52/584 X |
| 2,695,159 | 11/1954 | Bridwell | 52/293 |
| 2,815,656 | 12/1957 | Klein et al. | 52/293 |
| 3,119,204 | 1/1964 | Williams | 52/396 |
| 3,172,392 | 3/1965 | Schultz | 52/80 |
| 3,195,312 | 7/1965 | Drumsey | 52/293 |
| 3,295,286 | 1/1967 | Schaich | 52/584 |
| 3,678,815 | 7/1972 | Younker | 404/6 |
| 3,685,241 | 8/1972 | Cooper | 52/293 |
| 3,854,205 | 12/1974 | Kobayashi | 52/742 |
| 4,015,383 | 4/1977 | Crowley | 52/227 |
| 4,105,353 | 8/1978 | Bork | 404/6 |

*Primary Examiner*—William F. Pate, III
*Attorney, Agent, or Firm*—Charles C. Pistorino

[57] ABSTRACT

A concrete structure is erected by prefabricating a plurality of comparatively massive like-constructed substantially concrete slabs each of which has an elongated rectangular opening therein and a plurality of bores extending therethrough, transporting the prefabricated concrete slabs from a fabrication location to a building location, digging a ground foundation trench at the building location, successively placing the plurality of prefabricated concrete slabs, one-by-one, in substantially vertical orientation into said trench with the respective rectangular openings of said slabs all being located below grade in said trench, passing comparatively rigid elements through the bores in adjacent ones of said slabs to align said slabs with one another and to mechanically fasten them to one another, and thereafter anchoring the slabs in place by pouring or pumping a flowable anchoring material such as wet concrete into the trench to fill the trench and to pass from one side to the other of each of said slabs through the elongated rectangular opening in each slab. Preferred slab configurations are disclosed, as well as typical concrete structures which can be assembled by use of such slabs.

46 Claims, 27 Drawing Figures

FIG 1
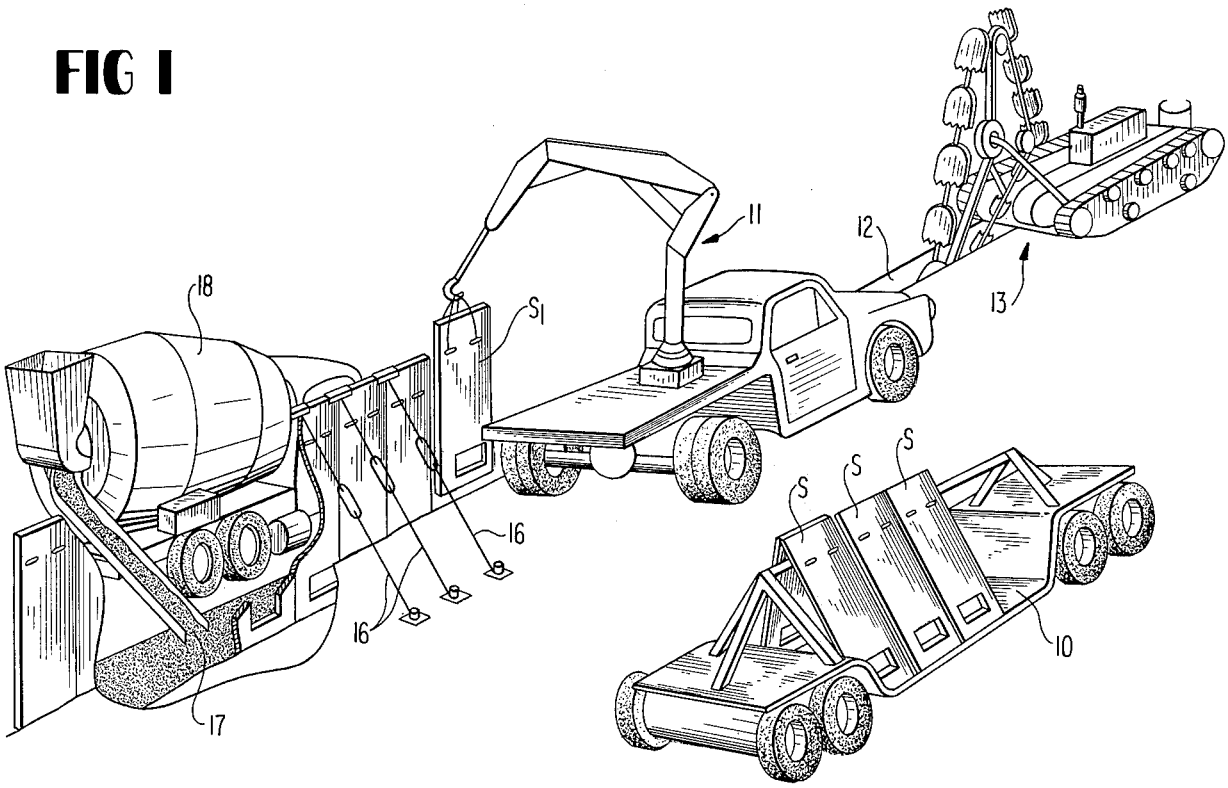
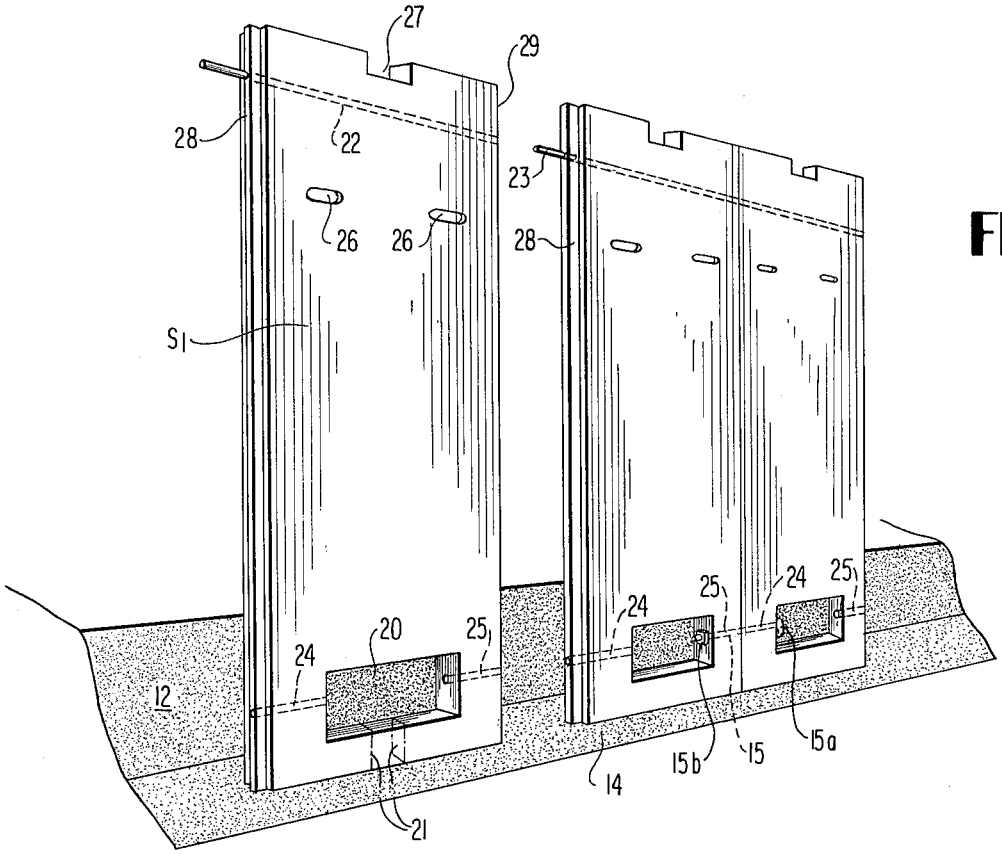
FIG 2

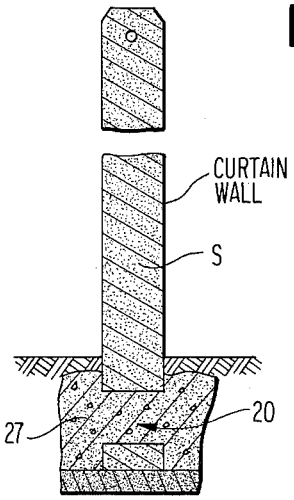
FIG 3
FIG 4
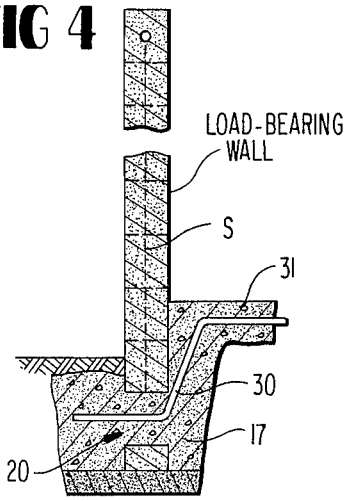
FIG 5
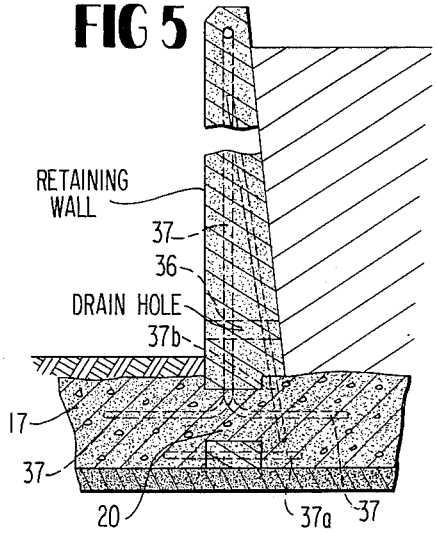
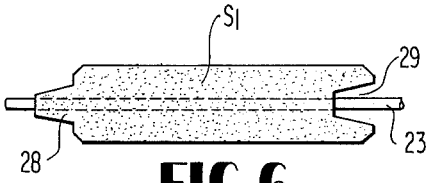
FIG 6
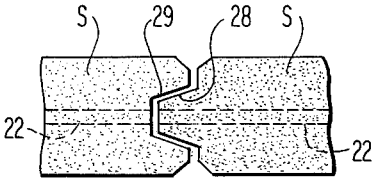
FIG 7
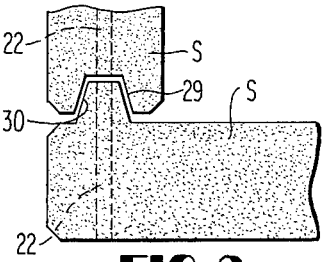
FIG 8
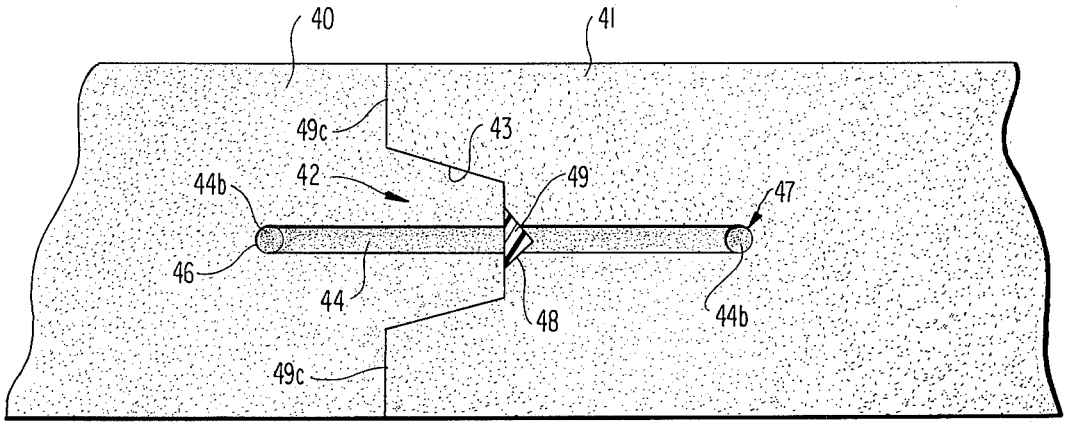
FIG 9a
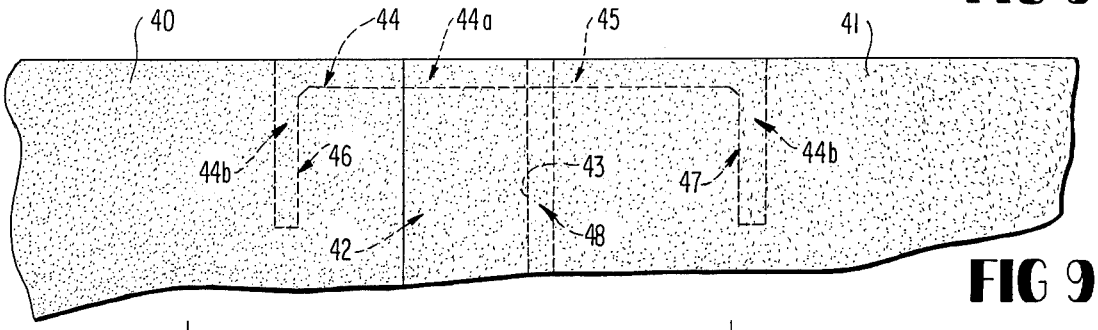
FIG 9b
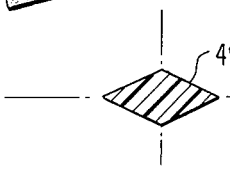
FIG 9c
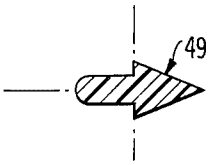
FIG 9d FIG 17b
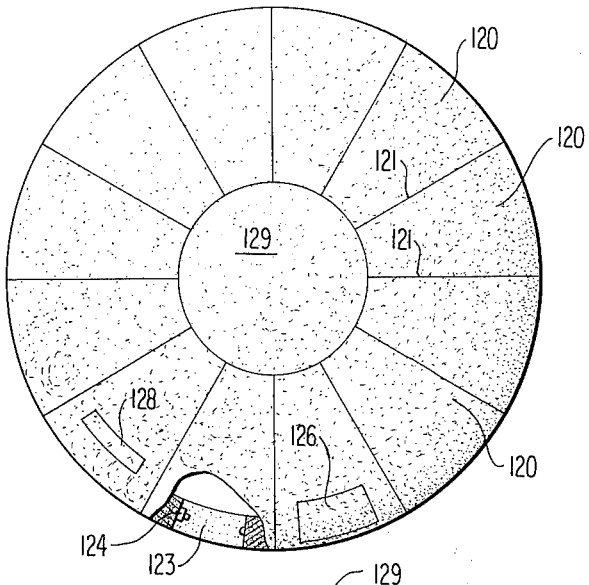
FIG 17a
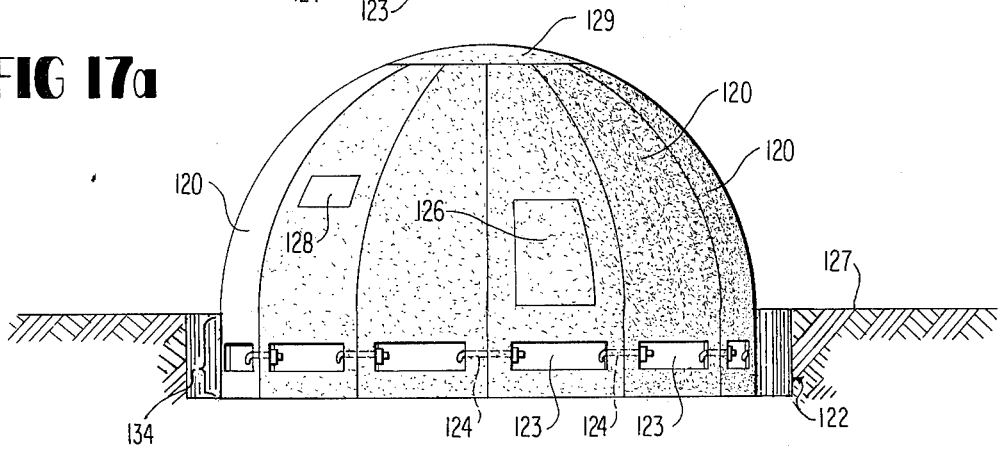
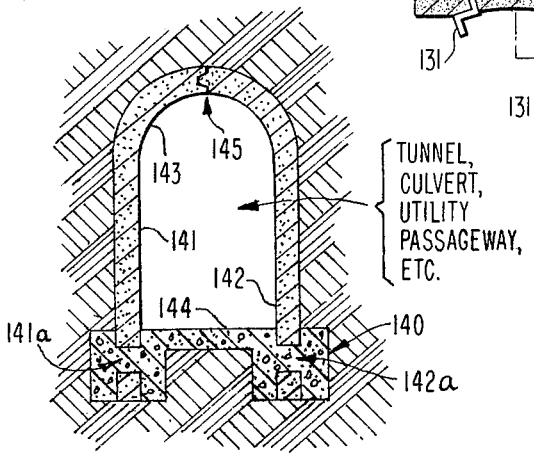
FIG 18
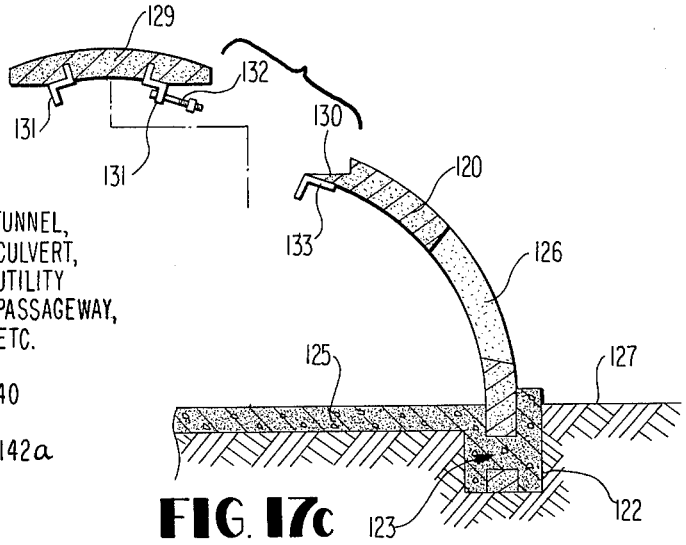
FIG. 17c

MULTI-PURPOSE PRECAST CONCRETE PANELS, AND METHODS OF CONSTRUCTING CONCRETE STRUCTURES EMPLOYING THE SAME

STATEMENT OF GOVERNMENT RIGHTS

The invention described herein may be manufactured and used by or for the Government for Governmental purposes without payment of any royalty thereon.

CROSS REFERENCE TO RELATED APPLICATIONS

Certain aspects of the subject matter disclosed and claimed herein were earlier disclosed in U.S. patent application Ser. No. 157,666 filed Dec. 7, 1961, for "Concrete Slabs", now abandoned.

BACKGROUND OF THE INVENTION

The present invention relates to concrete slab constructions, and methods of using the same, for standardizing the manufacturing and construction of precast concrete modules for monolithic and multi-purpose structures. The primary purpose of the invention is to provide a less expensive standardized method of manufacturing, transporting, handling and erecting fireproof concrete structures such as: (1) curtain walls adapted for use as military reventments or enclosures for aircraft, "soft-buildings" or stockpiles of equipment and supplies, and exterior and interior walls used in the construction of various types of military and commercial buildings, fences or boundary walls, and freeway dividers; (2) retaining walls such as those employed in irrigation and flood control ditches, small dams, sea walls, canals, and hillside retention; (3) load-bearing walls such as are employed in office buildings, cabins, huts, barracks, commissaries, supermarkets, warehouses, garages and schools; (4) building foundations; and (5) other concrete structures capable of utilizing the standardized multi-purpose precast concrete modules which form one aspect of the present invention.

The conventional methods employed at the present time for erecting building structures of the general types referred to above require the transport of comparatively small bricks, concrete blocks, or the like to a building site where they are laboriously assembled and/or the preparation of appropriate forms at a building site into which wet concrete may be poured and retained until set. These known techniques are comparatively time consuming, costly in respect to both the materials employed and the personnel required to fabricate a given structure at a building location, and often produce structures which are not as strong as may be desired under certain circumstances.

The present invention is intended to obviate these disadvantages.

SUMMARY OF THE INVENTION

The present invention relates to the fabrication and erection of building structures by use of prefabricated concrete panels which are placed in contiguous planar relation to one another within an elongated trench prepared in advance for the reception of such panels. The various types of prefabricated concrete panels contemplated by this invention each has a rectangular shape exhibiting a height ranging from a minimum equal to the depth of such trench to a maximum significantly greater than its width. Each type of panel, in use, is positioned upright in said trench with the width dimension of the panel extending substantially horizontally, is preferably, but not necessarily, shaped along its vertical edges to mate with a complementarily shaped edge on an adjacent panel (a tongue-and-groove configuration being one possible arrangement for the mating edges of adjacent panels), is provided adjacent its base edge with an elongated rectangular opening whose direction of extension is generally horizontal, i.e., transverse to the vertical edges of each panel, and is provided with a pair of aligning holes which are colinear with one another and which extend respectively from the opposite shorter edges of the aforementioned elongated rectangular opening through the body of the panel in a generally horizontal direction and open into the opposing vertical edges of the panel.

According to the size of a given job and its closeness to, or distance from, existing casting facilities, panels of the general configuration described may be prefabricated either at a temporary casting plant erected near the building site, or at an existing casting plant remote from the building site, as most economically advantageous, then transported, e.g., by a truck, to the building site, and placed in side-by-side vertical, coplanar relation to one another within the trench. The dimensions of the aforementioned rectangular openings are so selected that the entire opening in each such panel or slab is below grade when the panels are so positioned. Elongated "J"-bolts are inserted into the aforementioned aligning holes via the aforementioned elongated rectangular openings or apertures, and extend continuously from the elongated opening of one rectangular panel through the adjacent aligning hole of that panel, and then through the aligned aligning hole of the next adjacent panel into the rectangular opening of the said next adjacent panel, and are fixed in place by a nut which is threaded onto the portion of the said "J"-bolt which protrudes into the said elongated rectangular opening of the next adjacent panel to mechanically attach adjacent panels to one another. The size of the rectangular opening in each panel is sufficiently large to permit such insertion of "J"-bolts. As a practical matter, this means that the horizontal length of the rectangular base opening in each panel must not only be longer than the length of the "J"-bolts employed, but must also be more than twice the width of the panel between a vertical edge of said rectangular opening and the adjacent exterior vertical edge of the panel (in practice, the horizontal dimension of each such rectangular opening is more than one-half the width of the concrete panel in which it is located), and the vertical height of each such rectangular opening must moreover be sufficient to permit the insertion and manipulation of hand tools such as wrenches or the like to fasten the "J"-bolts in place and to clinch adjacent panels to one another.

Following this mechanical assembly of the panels, a settable anchoring material such as wet concrete is poured or pumped into the trench to fill the trench (the term "pouring" as used herein and in the appended claims being intended to include a "pumping" operation), and in the process to flow via the aforementioned rectangular openings from one side of each panel to the other, to completely fill the rectangular openings, thereby to embed the base portion of the several panels and their intervening "J"-bolts in an integrated, solid concrete footing. The end result of the fabrication and construction technique is, therefore, to rapidly assemble a continuous monolithic concrete structure through use of plural, standard, precast slabs, associated fastening elements such as "J"-bolts whose length is dimensionally related to the dimensions of specified portions of the panels and to the dimensions of the rectangular base openings therein, in an integrating mass of concrete.

In accordance with other features of the invention, depending on the specific type of panel according to the invention and its intended use, roof beam or floor joist slots can be provided in the upper edges of the panels; holes can be provided in each of the panels or slabs adjacent their upper edges to facilitate their manipulation; reinforcing rods can be provided in the poured concrete; auxiliary supporting or aligning structures can be employed; sealing cavities for the reception of sealing strips or flowable sealing compounds can be interposed between the engaging generally vertical edges of adjacent panels to provide a water-tight junction therebetween; the panels can be assembled in a double wall configuration with an intervening material such as sand placed therebetween; each precast concrete panel can be provided with a curvature in the direction of its width and/or length to permit the erection of nonplanar structures such as arched, curved and geodesic-type constructions; coloring or fluorescent materials can be employed in the concrete utilized in fabricating the slabs or panels; and/or the faces of the slabs or panels can be given embossed or highly decorative configurations, etc.

In general, therefore, the present invention relates to preformed concrete slabs or panels, and to methods of using the same, in the construction of low cost, high strength, rapidly erected concrete structures of various types. A principal objective of the invention is to provide a stock of concrete modules, slabs or panels which are preformed in desirable sizes for either load bearing, retaining and/or curtain walls. Another objective of the invention is to provide a reinforced concrete slab which is especially designed for monolithic type structures (walls to foundation to floor) that may be reinforced to meet specific design requirements. A still further object of the invention is to provide a method of fabricating into the slab an opening in the base footing for the rapid and accurate leveling and aligning of a given slab with adjacent modules at its base. A still further object is to provide a slab which is designed as a load-bearing wall, with monolithic attributes, and to obtain the structural strength of a pilaster which in turn will be reinforced with an identical and adjacent pilaster. Still another object of the invention with respect to its said monolithic and pilaster attributes, is to obtain a structure which has reactive resistance to ground and overhead pressures created by earthquakes, high velocity winds and/or extreme shockwaves above and below grade.

In addition to the foregoing, the principal objective of the invention is to provide, in a variety of useful types of concrete slab modules capable of being pre-cast by mass production methods, novel base-footing means adapting them to an equally novel method of transport, placement, connection and integration into monolithic structures, which achieves this as well as other objects of the present invention more rapidly, yet at less cost, and with fewer construction personnel, than had been required heretofore in the erection of concrete structures.

BRIEF DESCRIPTION OF THE DRAWINGS

The foregoing objects, advantages, construction and operation of the present invention will become more readily apparent from the following description and accompanying drawings wherein:

FIG. 1 diagrammatically illustrates the method of erecting a concrete structure, in accordance with the present invention, employing one of the various forms of standardized prefabricated concrete slabs of the present invention;

FIG. 2 is a perspective view, partially broken away, showing one of the forms of mating slabs of the present invention in process of elevation and base support;

FIG. 3 is a cross-sectional view of one of the slabs shown in FIG. 2, when employed in a curtain wall;

FIG. 4 is a view similar to FIG. 3 showing a load-bearing wall construction;

FIG. 5 is a cross-sectional view showing a retaining wall construction;

FIG. 6 is a plan view of one of the forms of pre-cast concrete slab of the present invention;

FIG. 7 is a partial plan view showing a typical mating arrangement of the adjacent slabs;

FIG. 8 is a partial plan view showing a typical corner slab construction;

FIGS. 9*a* and 9*b* are respectively a plan view and elevational view of a portion of two mating slabs constructed in accordance with the present invention and defining a sealing cavity for the reception of a sealing strip or a flowable sealing compound, and different fastening means therebetween, and FIGS. 9*c* and 9*d* show cross-sectional views of two alternative forms of sealing strips;

FIGS. 17*a*, 17*b* and 17*c* depict an igloo-type structure constructed in accordance with the present invention.

DESCRIPTION OF THE PREFERRED EMBODIMENTS

Figure 10:
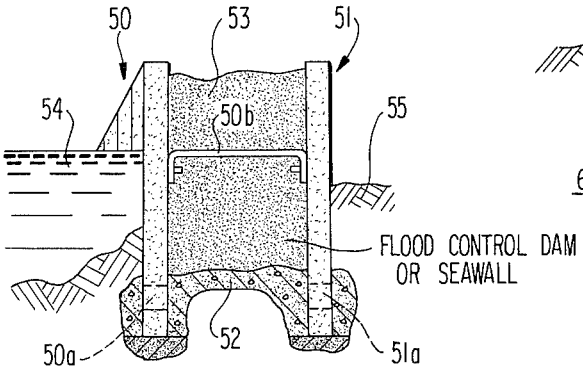
FIG. 10 shows a flood control dam, levee, or sea wall, constructed in accordance with the present invention.

Referring initially to FIG. 1, a plurality of like-constructed, standardized concrete slabs S are precast at a fabrication location for subsequent transport to a building location by means of a flat bed trailer 10 or the like, having inexpensive removable racks thereon for transporting the slabs or modules S to the construction site.

The slabs S can, if desired, be precast directly at the construction site by using a portable, ready-mix bulk plant, or, if it will be more economically advantageous, can be fabricated on a mass scale at a remote fabrication location dedicated to that purpose, and then transported to a building site as indicated in FIG. 1.

A typical slab S is designated $S_1$ in FIG. 2. While the dimensions of the slab will vary in dependence upon the end use to which it is to be put, the slab $S_1$ typically has a height of 12 feet 6 inches, a width of 5 feet, and a thickness of 3½ inches and can be reinforced by a gridwork of embedded one-half inch diameter reinforcing bars or rods (not shown) placed on approximately 14 inch centers. Obviously, any of these dimensions can be changed to meet specific needs, and the thicker the slab is made, and the more reinforcing used, the higher the overall structure can be. Also, where design considerations will permit, the portion of the slab that will be above ground does not have to be as thick as the base footing portion of the slab. And, where designs call for slabs of substantial thickness, or base footing portions of substantial thickness, especially for slabs according to the invention which are of lesser height, the slabs can be essentially free-standing in nature, further speeding the construction process.

A comparatively large opening 20 of elongated rectangular shape is provided at the lower end of the slab $S_1$. The general direction of elongation of the opening 20 is transverse to the height of the slab, and extends across the width of the slab as illustrated. For a slab of the dimensions previously given, the opening 20 may typically have a vertical height of substantially one foot and a horizontal width of substantially three feet, i.e., the horizontal dimension of the opening 20 is more than one-half the horizontal width of slab $S_1$. Opening 20 is, in the form shown in FIG. 2, disposed entirely interior of the slab, but if desired the lower edge of the opening 20 may open directly into the lowermost edge of the slab as depicted by broken lines 21 (and as shown in full lines in FIG. 14*b*). Moreover, while the edges of the opening 20 are planar as illustrated in FIG. 2, they may be of rounded configuration (as shown in FIG. 14*b*); and either such configuration is included within the term "rectangular" as employed herein.

Slab $S_1$ is further provided with a plurality of horizontal bores extending therethrough for use in alignment of each such slab with adjacent slabs, and for fastening the slabs to one another. One such bore 22, having a diameter of, .e.g, ½ inch, may be disposed near the top of the slab, opens into the opposing generally vertical edges of the slabs, and is intended to receive either a comparatively rapid alignment member 23 such as a metal rod, or a continuum intertie flexible cable. A further pair of ¾-inch diameter bores 24 and 25 extend horizontally in alignment with one another between the opposing generally vertical edges of rectangular opening 20 and the adjacent outermost vertical edges of the slab $S_1$. Due to the comparative horizontal dimensions of slab $S_1$ and of rectangular opening 20, the combined length of the bores 24 and 25 is less than the horizontal dimension of opening 20 whereby, as will become apparent subsequently, a comparatively long fastening element (such as a "J"-bolt having a length almost as long as the horizontal dimension of opening 20) can be inserted into the opening 20 of one slab, and then passed through the bore 24 of that one slab and through the aligned bore 25 of the next adjacent slab into the rectangular opening 20 of said next adjacent slab, where it may be fastened in place by a nut threaded onto the free end of the said bolt. The vertical height of opening 20 is sufficient to permit such a fastening element to be inserted and manipulated by hand tools such as wrenches or the like. The bores 24 and 25 preferably open into the vertical edges of recangular opening 20 at points thereon substantially midway between the upper and lower horizontal edges of said opening 20.

If desired, the bores 22, 24 and 25 may be cast in the slabs by properly positioning in the slab casting form permanent metal, plastic or cardboard sleeves, of inside diameters slightly larger than the outside diameters of the rods, cables or "J"-bolts to be used. During erection of the slabs these sleeves can then serve to facilitate the passage of the rods, cables or "J"-bolts through the slabs.

Slab $S_1$ may further include a pair of additional openings 26 (FIG. 2) adjacent the top of the slap adapted to cooperate with lifting equipment (as shown in FIG. 1) to facilitate the vertical placement and manipulation of the slab in a ground trench; and the uppermost edge of the slab may include a substantially centrally located notch 27 for the reception of roof beams or the like.

The opposing generally vertical edges of the slab $S_1$ are preferably shaped for mating engagement with complementarily shaped edges of the adjacent like-constructed such slabs. Various edge configurations can be utilized, e.g., the tongue and groove configuration 28, 29 best shown in FIG. 6, arranged to produce the mating engagement between adjacent slabs shown in FIG. 7. Alternatively, the slabs can be formed with a tongue 30 on one of the lateral faces thereof for engagement with an end groove 29 of an adjacent slab to form a corner construction of the type shown in FIg. 8. Other arrangements will be apparent to those skilled in the art.

Returning now to FIG. 1, a plurality of like-constructed standardized concrete slabs having the configuration described are erected in side-by-side closely adjacent relation to one another at a building location or construction site by means of lifting equipment 11, such as a hydraulic crane, fork lift, or the like which lifts the slabs S one-by-one from flat bed trailer 10 and lowers them, one-by-one, into an elongated trench 12 prepared in advance by digging or trenching equipment 13. The trench 12 is preferably of flat-bottomed V-shaped cross-section and is sufficiently deep that, when each slab S is lowered into said trench, the substantially rectangular opening 20 therein is entirely below grade. The slabs S rest, moreover, on a bed of sand or gravel 14 (see FIG. 2) previously placed on the bottom of the trench 12 to assist in leveling and aligning the slabs vertically with one another.

The slabs S are aligned horizontally and vertically with one another by workmen who operate the lifting equipment 11 and manipulate each slab S relative to the slabs previously placed in the trench, and the alignment is temproarily maintained by insertion of the aligning rod 23 through the several bores 22 (if such are provided in the slabs), and/or by "J"-bolts 15 (see FIG. 2) which are inserted through the aligned bores 24, 25 in adjacent slabs in the manner previously described. Each "J"-bolt is provided with an enlarged or curved end 15*a* which engages the generally vertical edge of the rectangular opening into which said "J"-bolt is initially inserted, and a nut 15*b* is then threaded onto the end of the bolt protruding into the rectangular opening of the next adjacent slab to clinch the slabs together.

As will be apparent from the foregoing, the actual arrangement of the aligning bores 24, 25 in a plane which includes both the side tongue and groove of each panel, and with access being provided by the transverse rectangular openings 20, permits axial-of-the-wall insertion of the clinching and aligning bolts 15, to assure that a clinching force is applied axially of the panels for maximum strength, straightness and stability of the wall during erection, and to avoid creating any tension stresses in the concrete of the slab. Moreover, the size of the openings 20 permits them to receive ordinary hand tools for the manipulation and fastening of the bolts 15 in place, thereby to apply a nondamaging and maximum clinching force immediately and axially of the adjacent panels as they are added, one-by-one, to the yet unanchored wall. This tends to assure that a progressive maximum stability of the comparatively heavy concrete slabs is attained during the erection process, supplemented if desired by anchoring devices such as guy wires or rods and associated turn buckles 16 which are attached to each panel after it has been inserted in the trench, aligned, and fastened to the next adjacent panel.

Following the foregoing steps, the trench 12 is filled with a flowable anchoring material such as wet concrete 17 which is poured into the trench from a concrete mixer 18, or which, if desired, may be forcibly pumped into the trench. The wet concrete completely fills the trench and, in the course of doing so, passes from one side to the other side of each of the concrete slabs through the rectangular opening 20 in each slab, to fill said opening and to embed the lower ends of the several slabs and the fastening elements 15 extending therebetween in a monolithic base footing support. It will be noted that this footing support is achieved without use of foundation forms, and that the base support, leveling, and aligning of the concrete slabs in mating relationship to one another is also accomplished without the use of conventional forms, which represents a major advantage over techniques used heretofore.

An end view of the final construction, when used as a curtain wall, is shown in FIG. 3. If the structure is to be used as a load-bearing wall, as shown in FIG. 4, reinforcing rods 30 may be used between the concrete floor 31 of the building structure and the openings 20 in each slab S to provide additional means for maintaining the slab wall, floor and foundation in an integral monolithic unit.

Slabs according to the invention can also be used to erect a retaining wall as shown in FIG. 5; and in this particular application of the invention, the several precast concrete slabs can be tapered in thickness upwardly (see FIG. 5) and can further be provided with one or more drain holes 36, both of which features are conventional in retaining wall construction. Reinforcing bars 37 which extend vertically through the slab may have their lower ends displaced in opposing generally horizontal directions in the region of opening 20 for extension into the trench pour. To reduce the weight of retaining wall slabs for ease of handling, the taper may be ended at the ground line, with the remaining lower portion of the slab being no thicker than the thickness of the slab at the ground line, since said remaining lower portion will in any event be augmented in strength by the encasing pour of concrete in the trench. The weight of individual retaining wall slabs may also be reduced by making them of less width than for lighter duty slabs. Also, for heavy duty slabs such as these, additional reinforcing bars, such as shown at 37*a* and 37*b* in FIG. 5, may be precast into the slab for further enhancing the monolithic intertie of the slab to the trench pour of concrete.

For each of the types of structures shown in FIGS. 3, 4 and 5, the method of erection of plural slabs follows the procedure previously described since, notwithstanding the presence of the reinforcing rods 30 and 37 in the structures shown in FIGS. 4 and 5, respectively, the wet concrete still flows freely through the slab openings 20.

The preformed reinforced slabs S may be brought quickly to a particular job, are easily disposed in proper vertical position, and are readily leveled and aligned by means of the aforementioned tierods and aligning bolts. Pouring (as hereinbefore defined) of the wet concrete in a freeflow manner through the openings 20 secures the slabs in position with optimum stress and shear values. The slab construction, transportation, and erection is accomplished in a low cost and rapid manner, and rapid completion of many types of building structures is made possible.

FIGS. 9*a* and 9*b* illustrate additional features which may be optionally included in the construction of the present invention. In addition to the aligning and clinching devices which have been previously described, or in replacement of some or all of these previously described devices, a pair of adjacent slabs 40, 41, provided with complementary vertical edges of tongue and groove configuration 42, 43, may be aligned adjacent their uppermost or generally horizontal edges by means of one or more "U"-shaped aligning and clinching bolts 44 each of which includes a generally horizontal leg 44*a* which extends between the two slabs 40, 41 along a depression 45 portions of which are formed in the top edge of each slab, and a pair of generally vertical legs 44*b* which are located in vertical holes 46, 47 provided respectively in the top edges of the two slabs 40, 41. Depending upon the intended final construction, more than one such U bolt 44 can be fastened into place across the top edges of adjacent slabs and/or one or more such U bolts can be mounted in place across the vertical junction between the vertical outer faces of the two slabs, and at one or more desired locations between the uppermost and lowermost edges of said slabs.

In addition, it may be desirable in certain applications to enhance the water tight integrity of the vertical junction between adjacent slabs by interposing one or more longitudinally extending ribbons of sealing material between the complementary edges when the slabs are assembled with one another. This, of course, could be done by merely brushing a sufficient thickness of a viscous sealing substance on either or both of the mating edges of adjacent slabs before they are joined. Also, a thin sheet of compressible sealing material brushed with paste, or provided with a self-sticking surface, on one side, could preliminarily be adhered in place on one of the mating edges before they are clinched together. However, it is desirable that cleaner and more positive sealing arrangements be used. Accordingly, sealing arrangements such as will now be described, which employ cavities in either or both of the mating edges of adjacent slabs, for the reception of sealing strips or flowable sealing compounds, are preferred.

One possible such preferred sealing arrangement is shown in FIGS. 9*a* and 9*b*, and comprises an additional generally V-shaped depression or cavity 48 which extends vertically along the base portion of the edge groove 43 of slab 41, and which cooperates with the tongue portion 42 of slab 40 to provide an elongated generally vertical channel of triangular cross section between the mating edges of the slabs 40, 41. An elongated and somewhat oversized and compressible sealing strip 49 is first preliminarily adhered in place in the cavity 48, as by pasting or self-sticking surfaces, and then compressed within cavity 48 by the forces exerted between slabs 40, 41 when they are clinched together, to provide a water tight vertical joint between said slabs. Alternatively, after the slabs have been clinched together, a settable liquid sealing material may be poured into the channel formed by cavity 48 from the top of the aligned slabs to fill said channel and to migrate into any discontinuities between the channels thereby to provide the desired water tight seal between the vertical edges of adjacent slabs.

Cross-sectional views of two other forms of sealing strips that may be used are shown in FIGS. 9*c* and 9*d*. In using these forms of sealing strips opposing cavities, of cross-sections similar to the respective halves of the seal to be received, are cast into each of the mating edges of adjacent slabs. In each case the sealing strip is made of a readily compressible material, and is slightly larger in appropriate dimensions than the cooperating cavities, so that the seal will be tightly compressed when the slabs 40, 41 are clinched together. For example, in the diamond shaped seal 49*a* shown in FIG. 9*c*, the cross-sectional length of the seal in the direction of slab width is slightly longer than the comparable cross-sectional length of the channel formed by the opposed cavities, so that the seal 49*a* will be appropriately compressed by the forces between slabs 40, 41 when they are clinched together. In use, this type of seal is first temporarily stuck in place in the cavity of one of the slabs, as by pasting, etc., before it is joined with the other slab. With the arrow shaped form of seal 49*b* shown in FIG. 9*d*, temporary pasting of the seal in one of the opposed cavities is not necessary. In this form of seal, the curved edge of the sealing strip may be slightly wider transverse of its centerline than the cavity into which it is to sit, so that it can be easily press-snapped and locked into its cavity in one of the slabs before that slab is joined with its mating slab. On the other hand, the arrowhead shaped edge of the sealing strip may be slightly longer along its centerline than the cavity into which it is to sit, so that this edge will reactively expand slightly transversely of its centerline into tight sealing relationship with its mating cavity when the adjacent slabs are brought into clinched relationship.

Other cross-sectional shapes of seals, such as circular or nipple and semicircle, etc., with appropriate complementary cavities, may be used in like manner as described above. It is also to be understood that sealing cavities and cooperating sealing strips can, if desired, be located on the end faces of the slab edges laterally of the tongues and grooves, as at 49*c* in FIG. 9*a*, or anywhere on the end faces of the slab edges when no special mating connections, such as tongues and grooves, are used. Also, it is to be understood that slabs having cavities for any shape of sealing strip whatever may nevertheless be used for pouring, into the channel formed by the cavities, a settable liquid sealing material, to provide the water tight seal between the vertical edges of adjacent slabs, if desired. Furthermore, where it is desired that the sealing arrangement be placed in a tongue and groove connection, or connections, such connection(s) may be placed laterally of the axial-of-the-wall plane of the aligning rods and "J"-bolts to preclude confrontation of such rods and bolts with the seals.

FIGS. 10–13 illustrate various concrete structures which may be erected by use of the slabs and associated methods of the present invention. As shown in FIG. 10, the walls of a flood control dam, levee, or sea wall can be provided by two groups 50, 51 of aligned precast concrete slabs constructed in accordance with the present invention, said groups 50, 51 being erected in spaced relation to one another within a comparatively wide ground trench into which an integrating mass 52 of anchoring material such as concrete is poured to flow through the rectangular openings 50*a* and 51*a* of said two groups to form a monolithic structure; and the region between the two groups 50, 51 of concrete slabs may be filled with earth or sand 53 to provide a massive barrier of high structural strength between a body of water 54 and adjacent dry terrain 55. If desired, the slabs in this application of the invention may be tapered and reinforced in the manner disclosed for retaining walls, as shown in FIG. 5. Horizontal tie/separation bars or rods 50*b* may also be affixed to the inner faces of the opposing slabs, as more clearly shown in similar applications in FIGS. 14*a* and 14*b*, for enhancing the stability of the structure during erection and may, if desired, be left thereafter for additional reinforcing.

Furthermore, depending on the extent of the static head or dynamic forces the water body may be expected to exert upon the dam, levee or sea wall, the region between the two groups of slabs 50, 51 may be entirely filled with a pour of concrete. When this option is used, additional generally horizontal networks of reinforcing bars (not shown) may be cast into the pour 52 between and passing into the trenches to provide additional means for maintaining the slab walls, the intervening floor, and the slab foundation footings in an integral monolithic unit. Also, still additional reinforcing elements (not shown) may be cast in the pour 52 so as to extend upwardly out of the pour between the slab groups 50, 51 for later encasement of the upwardly extending ends of such additional reinforcing elements in the secondary pour of concrete that will fill the entire remaining region between the two groups of slabs. Such intertieing of separate pours of concrete is a conventional practice in concrete construction. Moreover, when this option is used, the individual slabs of slab groups 50, 51 during their own fabrication may have additional reinforcing bars embedded therein so as to extend outwardly from the inner faces of the slabs, with the outwardly extending portions being bent appropriately, also for later encasement in the filling pour of concrete when it sets, to provide additional intertieing of the slabs with both pours of concrete, for further enhancing the integral consolidation, strength, rigidity, stability and other monolithic attributes of the structure.

For projects where a secondary pour of concrete is provided, as described above, the slabs 50, 51 can be seen to have eliminated the necessity for having to construct and later strip concrete pouring forms, resulting in much savings of time, materials and labor that would have been required to construct the resulting structure according to conventional methods.

Figure 11:
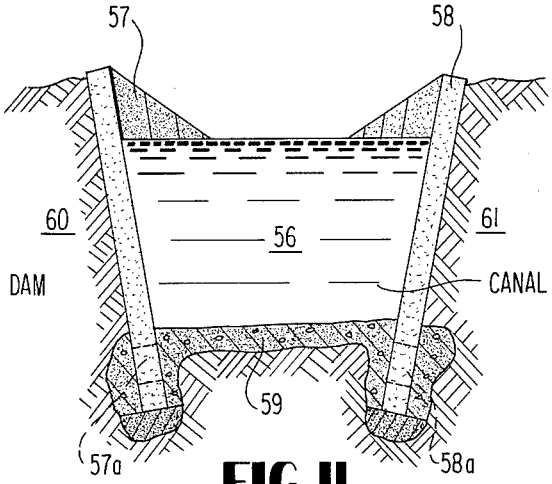
FIG. 11 shows a canal constructed in accordance with the present invention.

As shown in FIG. 11, a canal for confining the flow of a stream of water 56 may be fabricated by disposing a pair of groups 57, 58 of aligned precast concrete slabs in opposed facing relation to one another, and by integrating the bottoms of said groups 57, 58 by a mass of concrete 59 extending therebetween and through the bottom rectangular openings 57*a*, 58*a* of said groups. Each group 57, 58 has the characteristics of a retaining wall such as that previously described with respect to FIG. 5, and lies against an adjacent earthen mass 60, 61 respectively. In this canal application of the present invention, the two groups of slabs 57, 58 are preferably inclined somewhat to the vertical as illustrated in FIG. 11, so that the channel provided therebetween is wider at its top than at its bottom. If desired, the slabs in this application of the invention may also be tapered and reinforced in the manner disclosed for retaining walls.

Figure 12:
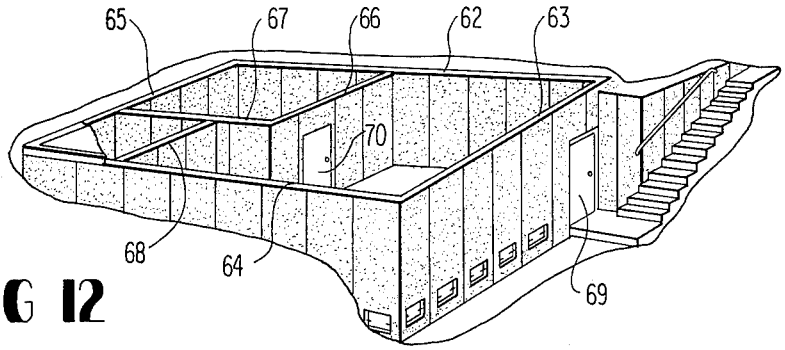
FIG. 12 depicts a basement and/or foundation constructed in accordance with the present invention.

The slabs of the present invention can also be employed to provide a basement and/or foundation for a building structure as illustrated in FIG. 12. In this utilization of the invention, the slabs can be aligned within ground trenches that are disposed in various orientations relative to one another, parallel, transverse, or at varying angles to one another, to provide boundary walls 62–65 inclusive, as well as interior walls such as 66–68 inclusive, all of which are disposed entirely or substantially entirely below grade. In addition, one or more of the slabs can be of special configuration to provide openings in which doors such as 69 and 70 can be installed.

Figure 13:
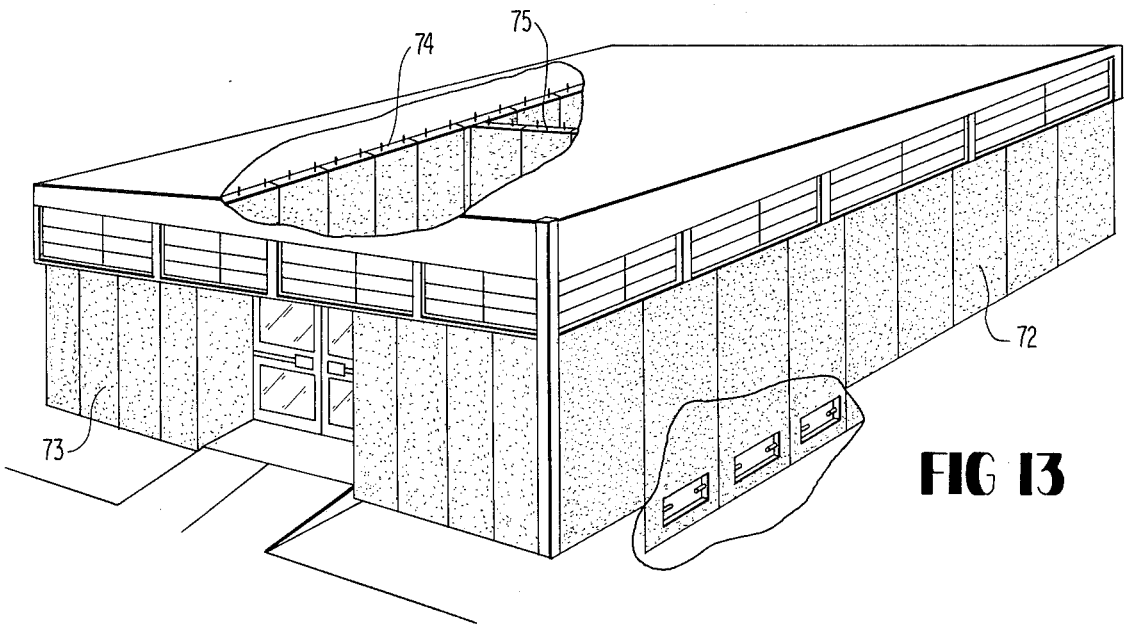
FIG. 13 depicts a building structure erected in accordance with the present invention.

FIG. 13 illustrates a building construction erected by use of the slabs and techniques of the present invention, adapted to be used for industrial or commercial purposes. In this case, exterior walls such as 72, 73 and 74 as well as interior walls such as 75, all of which have only their lowermost portions below grade with the remainder of the walls extending above grade, may be erected by placement of plural slabs constructed in accordance with the present invention within ground trenches that are appropriately oriented relative to one another.

Figure 14A:
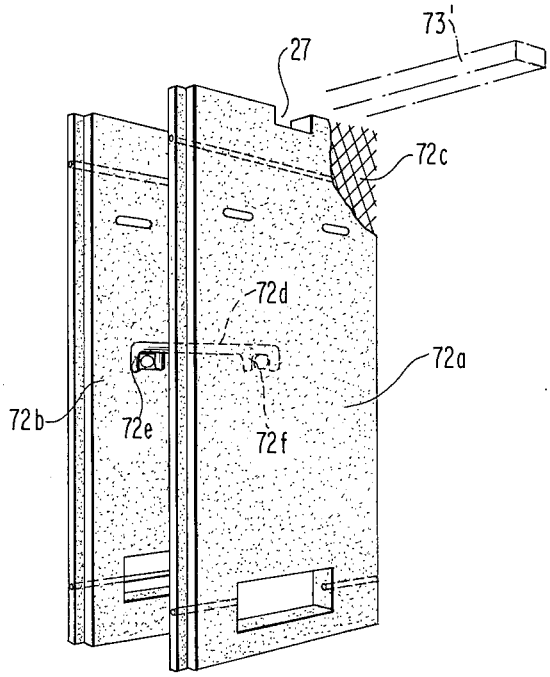
FIGS. 14*a* and 14*b* show double-wall constructions employing one of the forms of standardized pre-cast concrete slabs of the present invention.
Figure 14B:
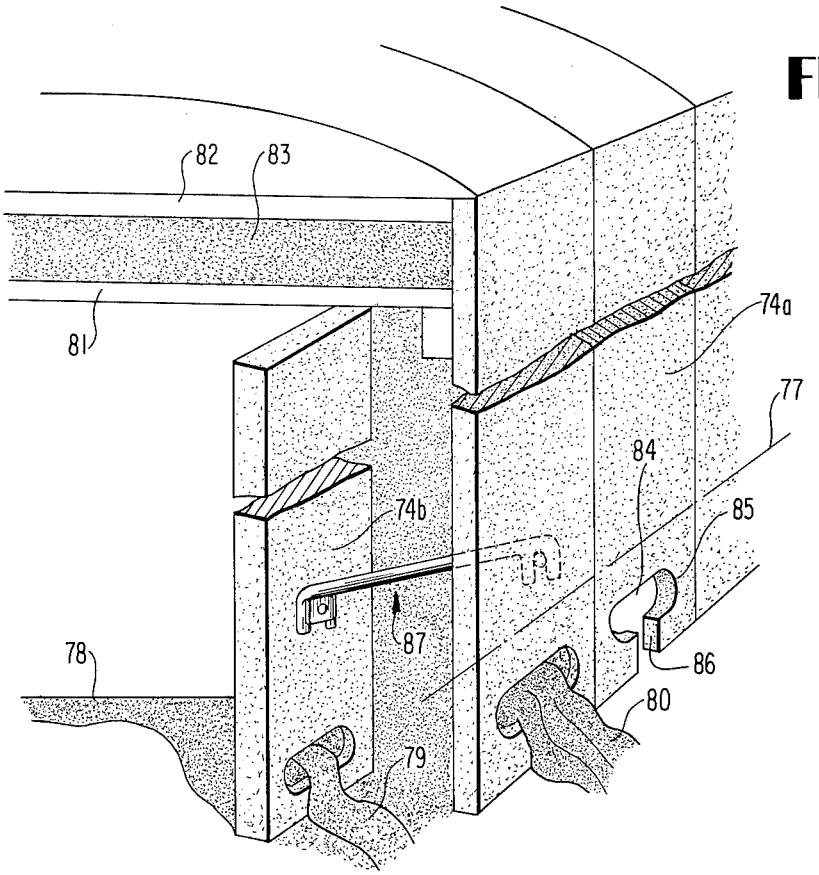

The individual slabs which form at least the exterior walls 72, 73 and 74 may, if desired, take the form and relative arrangement shown in FIG. 14*a*, i.e., each slab such as 72*a* may be internally reinforced by a metallic mesh 72*c* similar to metal fencing material, and pairs of slabs 72*a*, 73*b* so constructed may be disposed within parallel, relatively closely adjacent or merging ground trenches, to provide a double wall construction. Horizontal tie/separation bars or rods 72*d* may also be affixed to the inner faces of the opposing slabs for similar reasons as given for the flood control dam application shown in FIG. 10. As shown in FIG. 14*a* the tie/separation bars or rods 72*d* have bifurcated end portions 72*e* integral therewith and extending transversely of the length of the bars or rods so as to enable them to pass over bolts 72*f* embedded in or otherwise fastened to the inner faces of the slabs for proper positioning of the tie/separation bars or rods. The bolts 72*f* may be threaded on their protruding ends to receive nuts, as shown in FIG. 14*b*, to fasten the bars or rods 72*d* firmly to the slabs. The tie/separation bars or rods may be provided with other forms of fastening means, as desired, and may be made adjustable in length for more precise spacing of the slabs, as by making the bar in two sections connected by a turnbuckle, for example.

Furthermore, the intervening space between the slabs 72*a*, 72*b* may be filled if desired with various types of materials, according to the use intended for the structure, including sand, insulating material, radiation protection material, etc., or may be left as an air space. The top edge of each slab is provided with a depression 27 of the type previously described with respect to FIG. 2 which receives a roof beam 73' for supporting a roof structure of the type generally depicted in FIG. 13.

FIG. 14*b* shows another double wall construction which may be employed in accordance with the present invention. In this arrangement, the outer group of slabs 74*a* has a greater height than the inner group of slabs 74*b*, the lower ends of the two groups are each disposed below grade (indicated by ground level line 77) as in the other embodiments of the invention, and are integrated with one another by a mass of concrete which forms the interior floor 78 of the structure and which flows continuously from the floor portion of the structure through the horixzontal rectangular openings at the bottom of each slab as indicated at 79 and 80. The region between the two slab groups 74*a*, 74*b* can be filled with sand or other appropriate material. In addition, generally horizontal concrete slabs 81, 82 can be disposed in spaced relation to one another to extend across the top of slab group 74*b* into abutting relation with slab group 74*a* and the region therebetween can be filled with a further mass of sand 83 or other material. Typically, walls and ceiling which are effectively four feet thick can be fabricated by the techniques shown in FIG. 14*b* by employing six-inch thick concrete panels having three feet of filler material therebetween.

As also shown in FIG. 14*b*, the rectangular openings such as 84 through which the integrating mass of concrete flows at the bottom of each slab, can have curved edges such as 85 rather than straight edges, and can open as at 86 into the lowermost edge of each slab. The opening 86 actually depicted in FIG. 14*b* has a width which is only a fraction of the horizontal dimension of the opening 84, but the width of opening 86 can be increased to be as wide as, or substantially as wide as the horizontal dimension of the rectangular opening at the bottom of each slab. The openings 86 into the base edge of the slabs may be used both for facilitating the flow of wet concrete from one side of the trench to the other through the slabs and for additional intertieing of reinforcing bars on both sides of the trench, for applications requiring heavy reinforcing. The tie/separation bars or rods 87 are similar to those shown at 50*b* and 72*d* in FIGS. 10 and 14*a*.

Figure 15A:
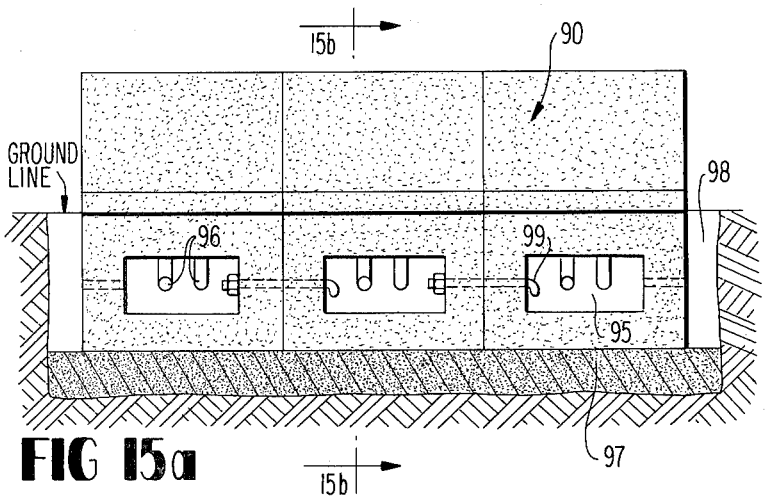
FIGS. 15*a* and 15*b* show longitudinal and cross-sectional views respectively, of a highway divider employing another of the forms of standardized pre-cast concrete slabs of the present invention.
Figure 15B:
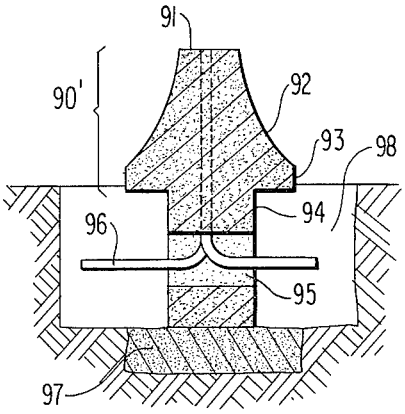

FIGS. 15*a* and 15*b* illustrate a freeway divider employing a preferred form of divider slab 90 fabricated in accordance with the present invention. FIG. 15*b* is a cross-sectional view along the line b—b of FIG. 15*a*. Both Figures show such divider slabs assembled in a trench as they appear just prior to, and ready for, the pour of encasing wet concrete. As shown in FIG. 15*b* the cross-sectional shape of this freeway divider slab is geometrically summetrical and arrow shaped in its vertical direction, with the head of the slab 90' comprising a narrow top surface 91, from which downwardly and outwardly flaring, concave side surfaces 92 extend to meet narrow vertically disposed side surfaces 93. The shape of the freeway divider slab's head portion as just described is conventional. The combining of the conventionally shaped head of the slab with a base footing of the type of the present invention, along with the other features now to be described, comprises my improvements over the conventional freeway divider. At the lower edges of the side surfaces 93 the slab jogs in horizontally to meet the base footing portion 94 of the slab, in which is located the elongated rectangular shaped flow-through opening 95 which is similar to the other such flow-through openings already discussed above. Reinforcing bars 96, which extend vertically through the upper portion of the slab exit at their lower ends into the flow-through opening 95, where they are bent generally horizontally to extend outwardly in opposing directions for extension into the trench. The slabs may be otherwise reinforced throughout in a conventional manner, if desired.

As shown in both FIGS. 15*a* and 15*b* the slabs have already been aligned and leveled on a bed of sand or gravel 97 previously placed and prepared on the bottom of the trench 98, and clinched together with "J"-bolts 99 as previously described. So, the freeway divider shown in these figures is ready for the pour of wet concrete that will encase the base footings 94. Such pour, in filling the trench, will pass from one side to the other of the concrete slabs through the rectangular openings 95 in each slab, to fill the said openings and enbed the base footing portions of the several slabs, the "J"-bolts, and the reinforcing bars 96 in a monolithic base footing support. The pour should extend upwardly at least to the lower edges of the vertical side surfaces 93 of the heads of the slabs, so as to completely encase the base footing portions 94 of the slabs, and may be extended slightly upwardly onto the said vertical side surfaces 93, if desired.

Figure 16A:
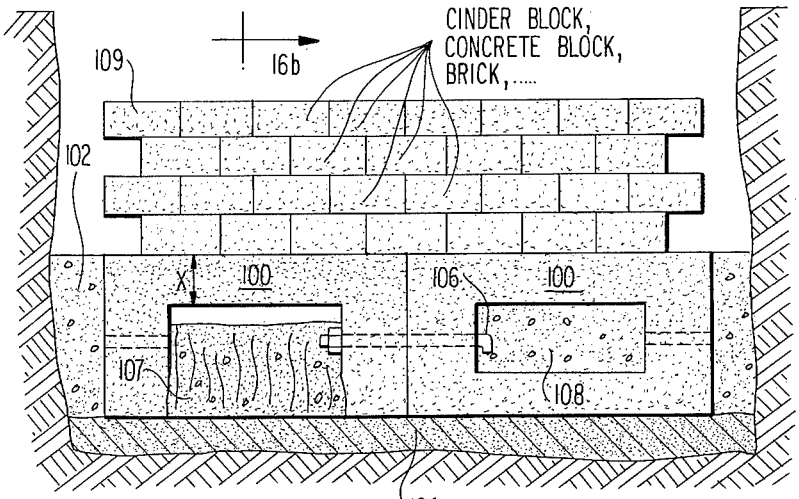
FIGS. 16*a* through 16*f* show a longitudinal elevation view, several cross-sectional views, and a plan view, respectively, of various forms of standardized pre-cast simple base-footing type slabs in accordance with the present invention, which type slabs accommodate the present invention to the construction of conventional brick, block or stone structures.
Figure 16B:
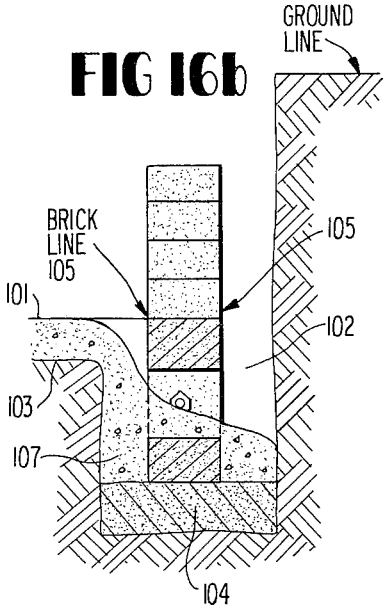

FIGS. 16*a* and 16*b* illustrate still another, and most basic, form of slab according to the present invention, a simple base footing slab. This type of base footing slab is for use where, for any reason, it is desired to have the associated wall structure constructed in a conventional manner of brick, stone, concrete block, cinder-block, etc. It is to be understood that the simple base footing type of slab shown in these Figures can be used for all kinds of walls, including curtain walls, retaining walls, load-bearing walls, building foundation walls, exterior building walls, etc., as may be desired. In FIGS. 16*a* and 16*b*, for convenience, this type of slab is shown being used in a basement construction, for the sole reason that such a construction is considered as being most ideally suited for revealing its many advantages over more conventional types of construction. From the discussion to follow it will be readily apparent how this type of slab according to the present invention may be used in constructing other types of masonry walled structures.

FIGS. 16*a* and 16*b* show how simple base footing slabs 100 can be used in constructing a basement where the basement floor 101 and the base footing slabs are to be joined by a single pour of wet concrete into a monolithic floor/foundation structure level with the top of the basement floor, and with a cinder-block, brick, or other multi-block masonry wall being built directly over the base footing slabs starting level with the top of the basement floor pour. FIG. 16*a* is a longitudinal view of a number of such simple base footing slabs 100 assembled in a trench 102 at the start of an encasing pour of wet concrete. FIG. 16*b* is a cross-sectional view along the line b—b of FIG. 16*a*. Other simple base footing slabs may be placed in trenches running internally of and generally parallel and perpendicular to the respective peripheral base footing slab groups of the foundation, to provide additional foundation support where required for the basement floor and, through basement floor supported structural elements, to the superstructure of the building, which expedient is conventional in building construction.

The showing, in FIGS. 16*a* and 16*b*, of some of the brick or block work already in place, together with the showing of the encasing pour of wet concrete just starting, is merely for convenience in illustration. Actually, no brick or block laying is started until at least a substantial section of floor and adjacent base footing slabs have been joined in a monolithic mass by a pour of wet concrete which has adequately set. In practice, construction using these simple base footing slabs will proceed generally as follows. The trench 102 and basement floor cut 103 are first dug to rough grade with an extra margin of depth in the trench 102 for the placement of a bed of sand or gravel 104 which is to be leveled to the proper elevation for receiving the base footing slabs 100. The elevation chosen to which the bed of sand or gravel 104 will be leveled may vary, but is preferably such that when the base footing slabs 100 are placed in position on the bed of sand or gravel the top surfaces of the base footing slabs will come up exactly to, or slightly above, the elevation planned for the top surface of the basement floor pour. The height, as well as the other dimensions of the simple base footings may, of course, also be varied according to the structural requirements for individual buildings and foundation conditions.

There are advantages for each such elevation for the top surfaces of the base footing slabs. For example, if the elevation chosen is such that the top surfaces of the base footing slabs come up exactly to the elevation planned for the basement floor pour, the top surfaces of the base footing slabs can be used as a guide for screeding the common floor and trench pour to the design grade of the basement floor pour 101. Also, in this example, the junctures 105 of the top edges of the base footing slabs with the adjacent floor and trench pour, will clearly show after the setting of the pour, so as to serve as a wall aligning guide to the masons for laying the bricks or blocks of the basement walls directly and accurately over the center of the footings. This will be especially appropriate if the thickness of the simple base footing slabs is the same or greater than the design thickness of the basement wall. If the elevation chosen for the bed of sand or gravel 104 is such that the top surfaces of the base footing slabs come up slightly above the elevation planned for the basement floor pour, the built-in alignment guides for laying the brick or block of the basement walls will be even more pronounced.

Having chosen a desired elevation for the bed of sand or gravel 104 as described above, the bed is then compacted and leveled to that elevation. Then the base footing slabs 100 are properly aligned in the various runs of trenches and clinched together in a continuous network by the "J"-bolts 106, to rigidly stabilize the whole base footing structure preparatory to the pour of wet concrete. Now the pouring of wet concrete 107 onto the floor cut 103, down into the trenches 102, and through the flow-through openings 108 in the base footing slabs, can be commenced to embed the several base footing slabs into a monolithic foundation structure including the basement floor. After the foundation structure, or a significant portion thereof, has adequately set, the laying of brick or blocks 109 for the basement walls can be commenced.

It should be obvious that buildings without basements, where a concrete floor is placed directly on the ground, and which are desired to have brick, block or stone exterior walls, can also be constructed using simple base footing slabs according to the method just described. Interior simple base footings, either connected to the peripheral base footings or not, as desired, can also be incorporated into the monolithic floor/foundation structure along proposed interior wall lines, and otherwise, for giving additional support to such interior walls and areas of the building that may be subjected to heavy floor loads.

Figure 16C:
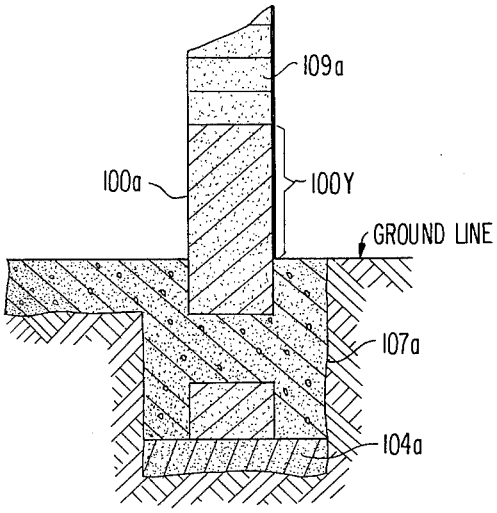

The simple base footing slab can also be adapted to the construction of other conventional designs of brick or block buildings constructed without basements. For example, continuing to consider buildings where a concrete floor is placed directly on the ground, a modified simple base footing slab may be used wherein the vertical dimension of that portion of the slab above the flow-through opening, designated by the dimension"x" in FIG. 16*a*, can be increased to extend the slab somewhat above ground level and the level of the common floor and trench pour, to form with like modified adjacent slabs an above ground load-bearing skirt wall extending only a few feet above ground all around the building and supporting an exterior brick or block wall thereabove. A construction such as this is shown in FIG. 16*c* wherein 104*a* indicates the bed of sand or gravel on which the slabs 100*a* are leveled and aligned, 107*a* the common floor and trench pour, 100*y* the skirt wall formed by increasing the vertical dimension of the simple base footing slab above the flow-through opening, and 109*a* the brick or block wall. Since, in this type of construction, the simple base footing slabs extend out of the trench pour and, therefore, will be directly exposed to weather and outside drainage conditions, it is preferable that the slabs be provided with some form of sealing means along their vertical edges as discussed in regard to FIGS. 9*a* through 9*d*.

Figure 16D:
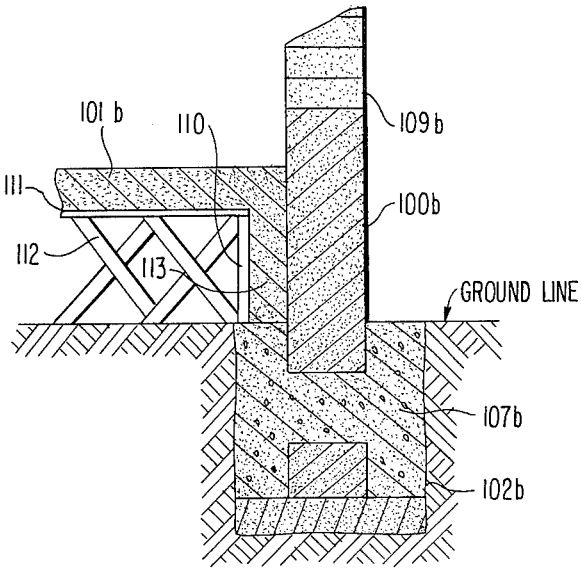

Modified simple base footing slabs having their upper portions somewhat extended such as discussed above and shown in FIG. 16*c* can also be used in basement-less structures having a concrete floor spaced above the ground, as may be desired in areas subject to possible high ground water problems. One such construction is shown in FIG. 16*d*. In this construction plain modified simple base footing slabs 100*b* similar to the slabs 100*a* of FIG. 16*c* are embedded monolithically with one another, to the ground line, in trench 102*b* by a pour of wet concrete, similarly as described above in connection with the structures shown in FIGS. 16*a*, 16*b* and 16*c*, except that no ground level floor is poured integrally therewith. Then, for pouring the above ground concrete floor 101*b*, any simple type of expendable form such as indicated at 110, 111 and 112 in FIG. 16*d* is placed in the close defined by a number of the exterior base footing slabs 100*b*, the next adjacent generally parallel group of interior base footing slabs (not shown), and two adjacent groups of interior base footing slabs (also not shown) which are generally parallel to one another and mutually generally perpendicular to both the line of exterior base footing slabs and the said next adjacent generally parallel group of interior base footing slabs.

In the type of construction just described the interior base footing slabs can be designed of a height to come up only to the level of the top of the horizontal floor form member 111, so that a continuous floor may be poured throughout the building, passing over and resting for support on the tops of said interior base footing slabs. It will be noted that in the construction shown in FIG. 16*d* the floor slab 101*b* is supported along the exterior base footing slabs by a downwardly extending leg 113 of concrete which is poured integrally with the floor slab 101*b*, and rests at its lower end on the previously set trench pour 107*b*. It is also to be noted that the interior faces of the exterior base footing slabs 100*b* cooperated with the downwardly extending form member 110 to dispense with the necessity for an outer form member for forming leg 113 of the floor pour. Although the floor slab may be additionally supported on the trench pours along the interior base footing slabs by downwardly extending legs similar to 113, this should not be necessary in most cases, because the interior support of the floor slab given by the interior base footing slabs will be adequate. For buildings where such additional support is not necessary, no vertical form member such as 110 will be necessary along the interior base footing slabs, and the horizontal form member 111 can be abutted directly against such interior base footing slabs with the top surface of the form member 111 being level with the top surfaces of the interior base footing slabs. The form supporting members indicated at 112 will not be specifically described since they are intended only to represent any and all conventional manners of supporting above ground concrete floor forms.

Figure 16F:
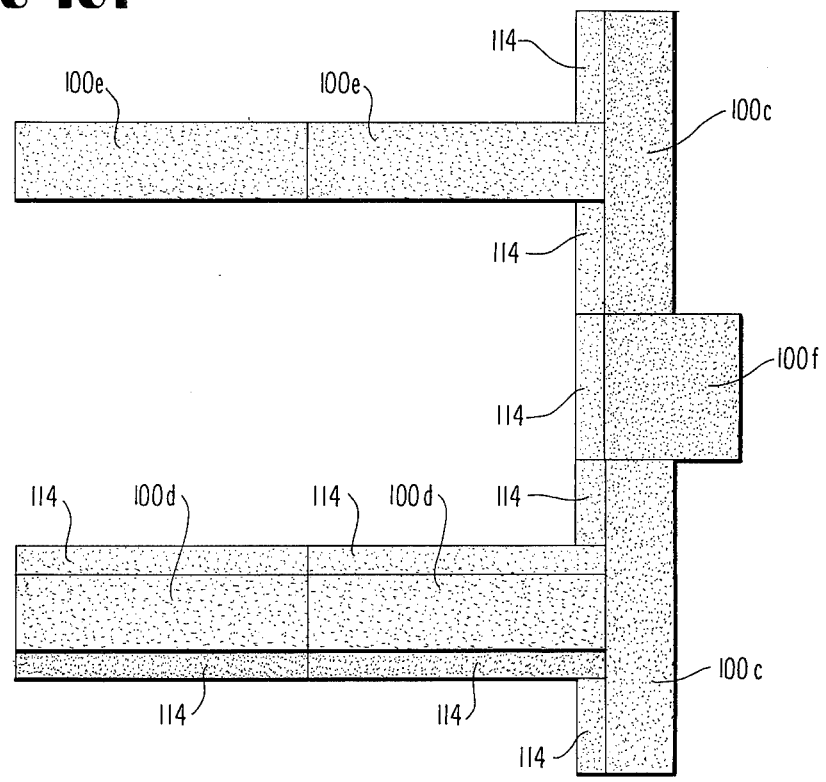
Figure 16E:
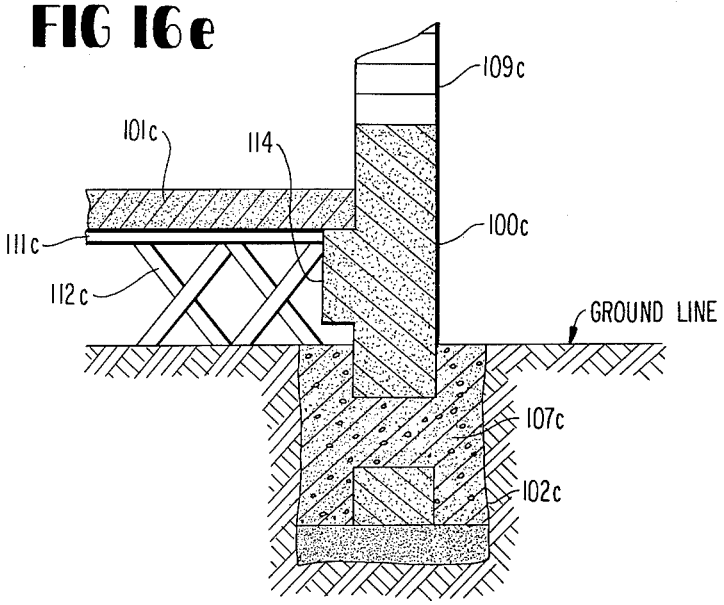

FIG. 16*e* shows a further modified form of simple base footing slab 100*c* which is especially adapted for use in the construction of conventional brick or block basement-less buildings having a concrete floor spaced above the ground, similar to the construction just discussed above and shown in FIG. 16*d*. The basic difference in these two constructions is that the construction shown in FIG. 16*e* employs a simple base footing slab 100*c* which has on its interior face an integrally cast ledge 114 which extends horizontally of the width of the slab 100*c*, parallel to both the upper and lower edges of the slab, with the lower edge of ledge 114 being either spaced upwardly of and clear of the trench pour 107*c*, or extending down to or slightly into the trench pour, depending on the amount of space between the ground line and the bottom of the floor pour, according to the design of the specific building involved. The purpose of this ledge is to support the floor slab 101*c* both while it is being poured and permanently thereafter, without the necessity of any side pouring form member such as 110 in FIG. 16*d*. Such ledges can also be cast along the upper sides of interior base footing slabs, if considered necessary in the design of a given building, for extra support of the floor slab 101*c*. The length of the ledges on exterior and interior base footing slabs which do not intersect other base footing slabs can be coextensive with the slabs. For slabs which intersect one another, the length of the ledges can be interrupted for proper mating, as shown in FIG. 16*f*, where examples of interior base footings 100*d* with ledges 114, and 100*e* without ledges, are shown intersecting exterior base footings 100*c* having such ledges. The showing of two interior groups of base footings 100*d* and 100*e* so close in FIG. 16*f* is convenience of illustration only.

It is to be understood that the common floor and trench pour shown in FIGS. 16*a*, 16*b*, and 16*c* may be reinforced by intertied networks of reinforcing bars, some of which pass from the floor into the trench and through the flow-through openings of the base footing slabs, as discussed earlier in this specification. Also, that the separate floor and trench pours shown in FIGS. 16*d* and 16*e* may also be reinforced with reinforcing bars. Further, that additional reinforcing elements (not shown) may be cast into the trench pour shown in FIG. 16*d*, and into the ledges 114 and the interior base footing slabs shown in FIGS. 16*e* and 16*f*, so as to extend upwardly out of those members and into the pour of the floor slabs 101*b* and 101*c*, for encasement in the floor slabs when they set, for enhancing the rigidity of a given overall structure, which such intertieing of separate pours of concrete is a conventional practice in concrete construction. It is also to be understood that, if desired, in the constructions shown in FIGS. 16*e* and 16*f*, a conventional wooden floor may be substituted for the concrete floor shown by running floor joists onto the ledges 114, for supporting conventional wooden subflooring over which a finished wooden floor can be placed. Or other types of conventional floors can be adapted for support on such ledges 114. Also, in any of the constructions shown in FIGS. 16*a*, 16*b*, 16*c*, 16*d* or 16*e*, at appropriately spaced intervals, exterior base footing slabs such as slab 100*f* in FIG. 16*f*, which may be of less width than the others, but are thicker, can be inserted to serve as pilasters for conventional purposes. It is felt that other adaptations of the simple base footing slab to conventional methods of building construction should readily appear to those skilled in the art. The adaptations disclosed above have been included herein to demonstrate some measure of the potential versatility of such simple base footing slabs.

The various structures thus far described all use rectangular slabs of generally planar configuration and generally uniform width throughout. However, the rectangular precast slabs of the present invention can be fabricated to exhibit a curvature in horizontal and/or vertical directions, such as might be employed in the construction of silos, wells, culverts, underground utility passageways, tunnels, underpasses, etc., or can also be fabricated to exhibit varying widths between the upper and lower edges of each slab. One such alternative slab configuration, and a type of concrete structure which can be assembled by use of such modified slabs, is shown in FIGS. 17*a*, 17*b* and 17*c*.

More particularly, a plurality of horizontally and vertically curved slabs 120 tapering symmetrically inwardly in width upwardly from a wider base width, and each of which is provided with complementarily shaped vertical edges 121 having, for example, the tongue and groove and seal configurations such as previously described, can be assembled in side-by-side relation to one another in a substantially circular ground trench 122 to form an igloo-type structure. The several slabs 120 are provided with elongated generally rectangular openings 123 for the reception of aligning and clinching "J"-bolts 124 which bolts, in this embodiment of the invention, are curved in their direction of elongation; and the slabs are then integrated with one another by a mass of anchoring material 125 which forms the interior floor of the structure and which extends continuously through the several openings 123 as depicted in FIG. 17*c*.

According to the specific use planned for such an igloo-type structure, and the type of soil and ground water conditions prevailing at a chosen site, various anchoring materials, either permanent or semipermanent in nature may be used, including materials that can be removed at a later date mechanically or otherwise, to permit disassembly of the structure for transportation, storage and later erection at some other location. For example, for permanent installations the anchoring material 125 can comprise a high strength portland cement concrete such as would be most appropriate for the other embodiments of the invention of, if design criteria permit, a structural light-weight concrete which would have less, but adequate, strength and better insulating characteristics for the floor. Any conventional floor covering, such as asphalt tile could be added. On the other hand, for temporary uses, where it is contemplated that the structure will be later disassembled, the anchoring material 125 can comprise materials such as polyurethane foam which has the desirable characteristics of being both a good insulating material and a substantially waterproof material. However, if polyurethane is used as the anchoring material, it would require that the floor and trench pour be provided with a thin covering of abrasive resistant and structurally firm material, such as wood and/or concrete, etc. Alternatively, for a semipermanent or temporary use, if desirable, the trench may be merely back-filled with the soil previously removed in digging the trench, since this type of structure is basically self supporting, and an impermeable plastic membrane, bonded along its periphery to the inner face of the structure, at ground level, by an appropriate sealing compound, can serve as the floor of the structure.

One or more of the slabs 120 can be provided with a comparatively large opening 126 disposed adjacent to but entirely above ground level 127 to act as a doorway, and one or more of said slabs 120 can be provided with another opening such as 128 adapted to act as a window. The uppermost edges of the assembled slabs define a generally circular opening having a diameter which is significantly less than the diameter of the structure at ground level 127, and this uppermost central opening can be closed by a domed cap 129 of precast concrete which rests on a shoulder 130 provided near the top edge of each slab, and which is adapted to be attached to the several slabs by cooperating clips and/or bolts of the types generally depicted at 131, 132 and 133. Furthermore, the vertical curvature of the slabs 120 can be stopped at the ground level 127, so that the lower base footing portions of the slabs may together form a vertical and circular skirt 134 of constant diameter extendig down into trench 122, as shown in FIG. 17*a*.

As was described with respect to FIGS. 9*a* through 9*d*, sealing material can be provided between the adjacent elongated edges of the several slabs 120, as well as between the uppermost edges of slabs 120 and cap 129 and, in addition, connector clips can extend across the junctions between adjacent slabs to assist in fastening the slabs to one another and drawing them tightly together.

In general, the types of construction which have thus been described are faster, more versatile, and represent a lower cost way of building many types of concrete structures than had been available heretofore. The sizes and methods of handling the various concrete modules are not restricted except for allowable transportation load limits. The engineering design of the various modules are standardized to incorporate multi and various types of handling devices, interlocking "V"-shaped grooves for wall and roof slabs, close tolerance alignment holes, a base footing incorporated into the wall section, monolithic type pilasters, openings for windows, doors, and utility fixtures and lines. Also, architecturally aesthetic designs can be precast into the surfaces of the slabs.

Openings can be precast in the modules to make the sections compatible with common and easily obtainable handling devices such as forklifts, A-frames, dollies, cherry pickers, cranes, flatbed trucks, etc. The interlocking edge grooves in the wall and roof slabs are designed for nochipping and are adapted to quickly and accurately mate one slab to another without the use of mortar. Precast standarized close tolerance alignment holes are conveniently located for inserting additional reinforcement rods and these rods can be used for rapid and accurate aligning, leveling, and tying together of two or more series of slabs. The base-footing in the wall slab is designed to provide optimum stress and shear values for walltype constructions. The cutaway section at the base of each slab allows for the free passage of wet concrete to encapsulate the lower section of the slab as a part of the building foundation and/or footing, and this base-footing feature eliminates the need for the costly and time-consuming practice of setting up and dismantling foundation forms.

The transportation of precast components of the type described from a manufacturing site to a construction site can be accomplished at a lower rate than can be effected to transport an equivalent amount of wet concrete and reinforcing materials. Flat bed trailers with inexpensive removal racks can be used for transporting the modules to a construction site, then left loaded at the construction site while the tractor returns an empty trailer to the manufacturing site, thereby eliminating need for wet concrete carriers that are subject to the high cost of capital expense, maintenance, and driver stand-by time prior to and during a concrete pouring activity. The exact amount of precast concrete to be transported can be predetermined, in contrast to wet-carriers which, on many occasions, have excess material that must be discarded as waste. A large number of high cost wet concrete carriers can be replaced by low cost flat bed trailers, and unskilled labor can be utilized to level out the work load. For all of these reasons, the modules of the present invention, and concrete structures erected by use of such modules, effect major cost savings while achieving the fabrication of configurations which are in many cases far stronger than those built by prior art techniques.

It is to be pointed out that whereas the various types of precast base footing slabs disclosed in this specification have been described as being cast of concrete and, except for certain applications of the igloo-type structure, monolithically joined to floors and/or foundations by concrete, it is considered to be within the contemplation of this invention that any of these types of slabs may be cast of any available moldable material suitable for any uses of the structures disclosed, with any type of compatible anchoring material. Also, that any individual auxiliary feature, or combinations thereof, such as tongue and groove connections, sealing arrangements, ties, etc., or methods disclosed in connection with any one type of slab or structure disclosed may, under appropriate conditions, be left out of the structures with which they are shown or mentioned, or be used with any other type of slab or structure disclosed or similar thereto. Furthermore, while it is preferred that "J"-bolts or their equivalents be used in all cases to rigidly clinch adjacent slabs together preparatory to the anchoring pour, such clinching of the slabs is not considered an absolute requirement of this invention. Nor is it considered necessary that all adjacent or intersecting slabs abut in straight-line, regular curve or perpendicular relation as shown, since irregular lines of slabs abutting together on chamferred or beveled edges, either unclinched or clinched with means other than "J"-bolts, are contemplated.

While I have thus described preferred embodiments of the present invention, many variations will be apparent to those skilled in the art. It must therefore be understood that the foregoing description is intended to be illustrative only and not limitative of the present invention, and all such variations and modifications as are in accord with the principles described are meant to fall within the scope of the appended claims.

Having thus described my invention, I claim:

1. A prefabricated concrete slab adapted for placement substantially vertically in an elongated foundation ground trench at a building location adjacent to prefabricated substantially vertically positioned like-constructed such slabs in the trench to form a building structure at said building location, said prefabricated concrete slab having means providing for a positive fixed horizontal and vertical anchoring of said slab into said foundation ground trench, after said prefabricated concrete slab is aligned in abutting relationship with other such slabs in said foundation ground trench, by a pour of flowable anchoring material filling said ground trench, said means comprising an opening of elongated rectangular shape adjacent one end of said slab, said rectangular opening being positioned in said slab for disposition entirely below grade when said one end of said slab is placed in the trench, so that said rectangular opening is adapted to pass and be filled by the flowable anchoring material which is to be poured into the trench after said one end of said slab has been placed in the trench, the direction of elongation of said elongated rectangular opening in said slab being transverse to the outer vertical edges of said slab and extending substantially horizontally when said slab is placed in the trench, and said slab further defining a pair of horizontally extending aligned bores which are located respectively between the opposed outer vertical edges of said slab and the substantially vertically disposed shorter opposed edges of said rectangular opening in said slab for use in aligning said slab with adjacent ones of such slabs prior to the pouring of the anchoring material into the trench, the diameter of each of said bores being significantly smaller than the width of the shorter opposed edges of said opening, the length of said rectangular opening being greater than the combined length of said bores to permit the insertion of an elongated alignment member into said opening in said slab for horizontal passage from said opening through one of said bores in said slab and through an aligned such bore in an adjacent one of such slabs and into the rectangular opening of the adjacent one of said slabs, and the height of said rectangular opening being sufficiently great to permit the ready manipulation of the elongated alignment member by hand tools inserted into said rectangular opening during the aligning of said slab with adjacent ones of such slabs in the trench.

2. The prefabricated concrete slab of claim 1 wherein said slab is of substantially rectangular configuration.

3. The prefabricated concrete slab of claim 1 wherein the vertical height of said slab is greater than the horizontal width of said slab.

4. The prefabricated concrete slab of claim 1 wherein the opposing faces of said slab are each of curved configuration.

5. A prefabricated concrete slab adapted to be transported as a unit from a fabrication location to a remote building location for placement substantially vertically in an elongated foundation ground trench at said building location closely adjacent to prefabricated substantially vertically positioned like-constructed such slabs in the trench to form a building structure at said building location, said prefabricated concrete slab being of substantially rectangular shape and having a height which is significantly greater than its width, the opposed outer edges of said slab in the direction of its height being shaped for mating engagement with complementarily shaped outer edges of the adjacent like-constructed such slabs in the trench, said prefabricated concrete slab having means providing for a positive fixed horizontal and vertical anchoring of said slab into said foundation ground trench, after said prefabricated concrete slab is aligned in abutting relationship with other such slabs in said foundation ground trench, by a pour of flowable anchoring material filling said ground trench, said means comprising an opening of elongated rectangular shape adjacent one end of said slab, said rectangular opening being positioned in said slab for disposition entirely below grade when said one end of said slab is placed in the trench, so that said rectangular opening is adapted to pass and be filled by the flowable anchoring material which is to be poured into the trench after said one end of said slab has been placed in the trench, the direction of elongation of said rectangular opening in said slab being transverse to the height of said slab and extending substantially horizontally when said slab is placed in the trench, and said slab further defining a pair of horizontally extending aligned bores which are located respectively between the opposed outer edges of said slab and the substantially vertically disposed shorter opposed edges of said rectangular opening in said slab for use in aligning said slab with adjacent ones of such slabs prior to the pouring of the anchoring material into the trench, the diameter of each of said bores being significantly smaller than the width of the shorter opposed edges of said opening, the length of said rectangular opening being more than the combined length of said bores to permit the insertion of an elongated rigid alignment member into said opening in said slab for horizontal passage from said opening through one of said bores in said slab and through an aligned such bore in an adjacent one of such slabs and into the rectangular opening of the adjacent one of said slabs, and the height of said rectangular opening being sufficiently great to permit the ready manipulation of the elongated rigid alignment member by hand tools inserted into said rectangular opening during the aligning of said slab with adjacent ones of such slabs in the trench.

6. The prefabricated concrete slab of claim 5 wherein the cross-sectional shapes of said opposed outer edges of said slab are respectively of tongue and groove configuration.

7. The prefabricated concrete slab of claim 5 wherein at least one of said elongated edges of said slab includes an elongated depression therein coextensive with said edge for the reception of a length of resilient sealing material adapted to provide a watertight joint between said edge and the complementarily shaped outer edge of an adjacent one of said slabs with which said slab is mated.

8. The prefabricated concrete slab of claim 7 wherein said one of said elongated edges is of groove configuration, said elongated depression being located in the base portion of said groove and being of V-shaped cross-section.

9. The prefabricated concrete slab of claim 5 wherein said elongated rectangular opening has a lower edge a portion of which opens into the lowermost edge of said slab.

10. The prefabricated concrete slab of claim 5 wherein said slab defines at least one further bore extending horizontally through the body of said slab in the region of said slab between the uppermost edge of said slab and the upper horizontal edge of said rectangular opening and along an axis substantially parallel to said pair of aligned bores for reception of a further alignment member.

11. The prefabricated concrete slab of claim 5 wherein said slab includes at least one further opening extending through the body of said slab along an axis transverse to said pair of aligned bores in the region of said slab between the uppermost edge of said slab and the upper horizontal edge of said rectangular opening.

12. The prefabricated concrete slab of claim 11 wherein said further opening is disposed closer to the uppermost edge of said slab than to the upper horizontal edge of said rectangular opening and is adapted to cooperate with lifting equipment to facilitate the vertical placement and manipulation of said slab in the ground trench.

13. The prefabricated concrete slab of claim 11 wherein said further opening is disposed relatively closely adjacent to the upper horizontal edge of said rectangular opening and is adapted to function as a drainage hole through said slab.

14. The prefabricated concrete slab of claim 5 wherein the thickness of said slab is greatest adjacent said one end of said slab and diminishes toward the other end of said slab.

15. The prefabricated concrete slab of claim 5 wherein said slab exhibits a curved configuration in the direction of its height.

16. The prefabricated concrete slab of claim 5 wherein said slab exhibits a curved configuration in the direction of its width.

17. A concrete structure comprising a plurality of generally rectangular substantially vertically oriented like-constructed prefabricated concrete slabs positioned closely edge-wise adjacent to one another, the lower end of each of said slabs being disposed within a foundation ground trench, each of said slabs having means providing for a positive fixed horizontal and vertical anchoring of said slabs into said foundation ground trench, after said prefabricated concrete slabs are positioned closely adjacent to one another in said foundation ground trench, by a pour of flowable anchoring material filling said ground trench, said means comprising an elongated substantially rectangular opening extending in a generally horizontal direction and located within said foundation ground trench at a position entirely below grade, the horizontal dimension of the rectangular opening in each of said slabs being equal to at least slightly more than one-half the width of said slab, structural means extending in a generally horizontal direction between and in engagement with adjacent ones of said slabs for aligning said slabs horizontally and vertically with one another, said structural means comprising at least one bore extending horizontally through the body of each of said slabs between the opposing generally vertically extending edges of said slab and an elongated member located within and passing continuously from the said bore in each of said slabs into the said bore in an adjacent one of said slabs, and a flowable anchoring material filling said foundation ground trench and, as it does so, extending from one side of each of said slabs through the rectangular opening in said slab to the other side of said slab, and thereby filling said rectangular opening, for positively retaining said slabs in fixed horizontal and vertical position within said foundation ground trench.

18. The structure of claim 17 wherein the vertical height of each of said slabs is greater than its horizontal width, the opposing generally vertically extending edges of each of said slabs being shaped to engage and mate with complementarily shaped generally vertically extending edges of the adjacent ones of said slabs.

19. The concrete structure of claim 17 wherein said bore in each of said slabs comprises a first bore which opens into and extends horizontally from one of the generally vertical edges of said slab to and opening into one of the generally vertical edges of the rectangular opening in said slab, and a second bore which opens into and extends horizontally from the other of the generally vertical edges of said slab to and opening into the other of the generally vertical edges of the rectangular opening in said salb, said first and second bores being aligned with one another and opening into said generally vertical edges of said rectangular opening at positions spaced from the upper and lower horizontal edges of said rectangular opening, said elongated member comprising an elongated bolt having a length greater than the combined width of the portions of each of said slabs between the generally vertical edges of said slab and the adjacent generally vertical edges of the rectangular opening in said slab, and the height of said rectangular opening in each of said slabs being sufficiently great to permit the insertion of hand tools into said openings for fastening said bolt in place.

20. The concrete structure of claim 19 wherein each of said slabs further comprises a third bore parallel to said aligned first and second bores, said third bore extending between and opening into the opposing generally vertically extending edges of said slab at a position between the upper horizontal edge of the rectangular opening in said slab and the uppermost edge of said slab, and an elongated member which passes continuously from the third bore in each of said slabs into the said third bore in an adjacent one of said slabs.

21. The concrete structure of claim 17 wherein at least one of the generally vertically extending edges of each of said slabs defines a depression therein which is coextensive with said edge and which forms a vertically extending channel between said edge and the mated complementarily shaped edge of an adjacent one of said slabs for receiving a sealing material within said channel to provide a watertight joint between said mated edges of said adjacent panels.

22. The concrete structure of claim 17 including a fastening means which extends across the joint between the mated vertically extending edges of an adjacent pair of said slabs and is embedded respectively within said pair of slabs.

23. The concrete structure of claim 17 including a U-shaped fastening member the base of which extends across the joint between the mated vertically extending edges of an adjacent pair of said slabs and the legs of which are embedded respectively within said pair of slabs.

24. The concrete structure of claim 23 wherein the legs of said U-shaped fastening member extend generally vertically and are embedded within said adjacent pair of slabs at the uppermost ends of said slabs.

25. The concrete structure of claim 17 wherein said anchoring material is concrete.

26. The concrete structure of claim 17 wherein said anchoring material is gravel.

27. The concrete structure of claim 17 wherein said plurality of slabs comprise a first group of said slabs disposed in a first elongated ground trench, and a second group of said slabs disposed in a second elongated ground trench extending generally parallel to and spaced from said first ground trench.

28. The concrete structure of claim 27 wherein said first and second ground trenches are disposed relatively closely adjacent one another whereby said first and second groups of slabs form a double wall structure.

29. The concrete structure of claim 28 including a body of sand filling the region between said first and second groups of slabs.

30. The concrete structure of claim 27 wherein said first and second ground trenches are disposed relatively remote from one another whereby said first and second groups of slabs form a canal therebetween.

31. The structure of claim 30 wherein said two groups of slabs are connected between the upper parts of their respective trenches by a concrete floor which is formed by a common pour of anchoring material into the two trenches and across the floor area therebetween so as to join the two groups of slabs and the floor monolithically.

32. The concrete structure of claim 27 wherein said first and second groups of slabs are inclined relative to one another to space the tops and bottoms of said groups of slabs at different distances from one another.

33. The concrete structure of claim 17 wherein each of said slabs is curved in two dimensions whereby said plurality of slabs forms a geodesic configuration.

34. The concrete structure of claim 17 wherein each of said slabs is curved in at least one dimension whereby said plurality of slabs forms a generally circular configuration.

35. The concrete structure of claim 27 wherein each of said slabs is curved in at least one dimension whereby said plurality of slabs forms a generally tubular configuration.

36. The method of forming a concrete structure which comprises prefabricating at a fabrication location a plurality of like-constructed substantially rectangular concrete slabs each of which has at least one bore extending therethrough in the direction of its width, and each of which has an elongated rectangular opening adjacent one end thereof extending in the direction of the width of said slab and having a length in its direction of extension which is at least slightly more than one-half the width of said slab; transporting said prefabricated concrete slabs from said fabrication location to a building location; digging a foundation ground trench at said building location; then successively placing said plurality of prefabricated concrete slabs one-by-one in substantially vertical orientation into said trench with the respective rectangular openings of said slabs all being located entirely below grade in said foundation ground trench and with the generally vertical edges of each of said slabs extending upwardly out of said trench and disposed closely adjacent to the generally vertical edges of the next adjacent ones of said slabs; then aligning each of said prefabricated concrete slabs horizontally and vertically with respect to a next adjacent prefabricated concrete slab by inserting an elongated rigid alignment element into the said bore in each of said slabs and into the said bore of an adjacent one of said slabs; then mechanically fastening each of said prefabricated concrete slabs to a next adjacent one of said slabs; and thereafter fixedly structurally anchoring said prefabricated concrete slabs, both horizontally and vertically, in place within the confines of the said foundation ground trench, by pouring a flowable anchoring material into said foundation ground trench to fill said trench and, thereby, to pass said flowable anchoring material from one side of each of said concrete slabs to the other side thereof through the said elongated rectangular openings in said prefabricated concrete slabs.

37. The method of claim 36 wherein said each of said slabs is prefabricated to provide a pair of aligned bores extending in the direction of the width of said slab between the opposed generally vertical edges of the elongated rectangular opening in said slab and the opposed generally vertical edges of said slab respectively, said aligning step comprising passing an elongated bolt from the elongated rectangular opening in one of said slabs through one of said pair of bores in said one slab into one of said pair of bores in a next adjacent one of said slabs and into the elongated rectangular opening in said next adjacent slab, said mechanical fastening step comprising pulling the opposing ends of said bolts into tight engagement with the adjacent vertical edges of the elongated rectangular openings in said adjacent slabs respectively, said anchoring step being operative to embed said bolts in said anchoring material.

38. The method of claim 37 wherein said bolt is of J-configuration having a curved portion at one end thereof which overlies the vertical edge of the elongated rectangular opening in one of said slabs and having a remote threaded end which extends into the elongated rectangular opening in the next adjacent slab, said mechanical fastening step comprising the step of placing a nut on the threaded end of said bolt and turning said nut by means of a hand tool inserted into the elongated rectangular opening in said next adjacent slab to generate an axial clinching force between said adjacent slabs in the direction of their respective widths.

39. The method of claim 38 wherein said anchoring step comprises pouring wet concrete into said ground trench.

40. The method of claim 36 wherein each of said slabs is curved in the direction of its width, said digging step producing a trench which is curved in the direction of its elongation substantially in conformity with the curvatures of said slabs.

41. The method of claim 40 wherein each of said slabs is also curved in the direction of its height, said digging step producing a trench having the configuration of a closed loop, whereby the placing of said slabs into said trench forms a structure of open-topped igloo configuration, and said method further including the step of attaching a cover structure to said slabs adjacent their respective upper ends to cover said open-topped igloo configuration.

42. The method of claim 36 wherein each of said slabs is prefabricated to define an elongated depression which is coextensive with at least one of the generally vertical edges of said slab and which cooperates with the adjacent edge of the next adjacent one of said slabs to form a vertically extending channel between the adjacent generally vertical edges of said slabs, said method including the step of inserting a sealing material into said channel to form a watertight joint between said adjacent generally vertical edges of said slabs.

43. The method of claim 42 wherein said inserting step comprises pouring a settable sealing material into said channel from the uppermost end of said channel.

44. A prefabricated concrete slab adapted for placement substantially vertically in an elongated foundation ground trench at a building location adjacent to prefabricated substantially vertically positioned like-constructed such slabs in the trench to form a building structure at said building location, said prefabricated concrete slab having means providing for a positive fixed horizontal and vertical anchoring of said slab into said foundation ground trench, after said prefabricated concrete slab is aligned in abutting relationship with other such slabs in said foundation ground trench, by a pour of flowable anchoring material filling said ground trench, said means comprising an opening of elongated rectangular shape adjacent one end of said slab, said rectangular opening being positioned in said slab for disposition entirely below grade when said one end of said slab is placed in the trench, so that said rectangular opening is adapted to pass and be filled by the flowable anchoring material which is to be poured into the tench after said one end of said slab has been placed in the trench, the direction of elongation of said elongated rectangular opening in said slab being transverse to the outer vertical edges of said slab and extending substantially horizontally in the direction of the width of said slabs when said slab isplaced in the trench, the length of said rectangular opening being at least about one-half the width of said slab, and the height of said opening being at least adequate for the ready passing and filling of said opening by said flowable anchoring material.

45. The method of forming a concrete structure which comprises prefabricating at a fabrication location a plurality of like-constructed substantially rectangular concrete slabs each of which has an elongated rectangular opening adjacent one end thereof extending in the direction of the width of said slab and having a length in its direction of extension which is at least slightly more than one-half the width of said slab; transporting said prefabricated concrete slabs from said fabrication location to a building location; digging a foundation ground trench at said building location; then successively placing said plurality of prefabricated concrete slabs one-by-one in substantially vertical orientation into said trench with the respective rectangular openings of said slabs all being located entirely below grade in said foundation ground trench and with the generally vertical edges of each of said slabs extending upwardly out of said trench and disposed closely adjacent to the generally vertical edges of the next adjacent ones of said slabs; and thereafter fixedly structurally anchoring said prefabricated concrete slabs, both horizontally and vertically, in place within the confines of the said foundation ground trench, by pouring a flowable anchoring material into said foundation ground trench to fill said trench and, thereby, to pass said flowable anchoring material from one side of each of said concrete slabs to the other side thereof through the said elongated rectangular openings in said prefabricated concrete slabs.

46. A prefabricated concrete slab adapted to be placed in a wall or the like of a building structure edgewise closely adjacent to prefabricated like-constructed such slabs to form a building structure, said prefabricated concrete slab being of substantially rectangular shape, said prefabricated concrete slab having means for aligning it with and fastening it fixedly to other such slabs after said slab is placed in abutting relationship with other such slabs in the building structure, said means comprising at least one opening of elongated rectangular shape positioned entirely interiorly of all the edges of said slab, the direction of said elongated rectangular opening in said slab being transverse to two opposite edges of said slab, said means further comprising at least one pair of aligned bores which are located respectively between the said opposite edges of said slab and the shorter opposite edges of said rectangular opening in said slab, the diameter of each of said bores being significantly smaller than the width of the shorter opposite edges of said opening, the length of said rectangular opening being greater than the combined length of said bores to permit the insertion of an elongated alignment and fastening member into said opening in said slab for passage from said opening through one of said bores in said slab and through an aligned such bore in an adjacent one of such slabs and into the rectangular opening of the adjacent one of said slabs, and the width of said rectangular opening being sufficiently great to permit the ready manipulation of the elongated alignment and fastening member by hand tools inserted into said rectangular opening during the aligning and fastening of said slab with adjacent ones of said slabs of the building structure.

* * * * *